US011404261B2

(12) United States Patent
Suzuki et al.

(10) Patent No.: US 11,404,261 B2
(45) **Date of Patent: *Aug. 2, 2022**

(54) METHOD, DEVICE, AND BASE FOR PREPARING MEASUREMENT SAMPLE FOR MALDI MASS SPECTROMETRY

(71) Applicant: Ricoh Company, Ltd., Tokyo (JP)

(72) Inventors: Kazumi Suzuki, Shizuoka (JP); Katsuyuki Uematsu, Shizuoka (JP); Hiroyuki Suhara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/202,594

(22) Filed: Mar. 16, 2021

(65) Prior Publication Data

US 2021/0296109 A1 Sep. 23, 2021

(30) Foreign Application Priority Data

Mar. 23, 2020 (JP) ..... JP2020-050881
Mar. 4, 2021 (JP) ..... JP2021-033985

(51) Int. Cl.
*H01J 49/16* (2006.01)
*H01J 49/04* (2006.01)

(52) U.S. Cl.
CPC ..... *H01J 49/164* (2013.01); *H01J 49/0418* (2013.01)

(58) Field of Classification Search
CPC ..... H01J 49/164; H01J 49/0418
See application file for complete search history.

(56) References Cited

U.S. PATENT DOCUMENTS 11,094,517 B2 * 8/2021 Uematsu ..... H01J 49/0418
2005/0019223 A1 1/2005 Platt et al.
2005/0032236 A1 2/2005 Axelsson
(Continued)

FOREIGN PATENT DOCUMENTS

EP 3 263 339 A1 1/2018
JP 2001-153842 6/2001
(Continued)

OTHER PUBLICATIONS

Extended European Search Report dated Aug. 3, 2021 in European Patent Application No. 21162155.2, 10 pages.
(Continued)

*Primary Examiner* — Nicole M Ippolito
*Assistant Examiner* — Hanway Chang
(74) *Attorney, Agent, or Firm* — Xsensus LLP

(57) ABSTRACT

A method for preparing a measurement sample for MALDI mass spectrometry, the method including applying a laser beam to a base including a matrix used for preparing the measurement sample for MALDI mass spectrometry, the matrix being disposed on a surface of the base, in a manner that the laser beam is applied to a surface of the base opposite to the surface including the matrix, to make the matrix fly from the base to be disposed at a predetermined position of an analyte of MALDI mass spectrometry, wherein the base includes a laser energy absorbable material, and wherein laser energy of the laser beam has a wavelength of 400 nm or longer.

14 Claims, 27 Drawing Sheets

(56) References Cited

U.S. PATENT DOCUMENTS

| | | | |
|---|---|---|---|
| 2010/0090099 | A1 | 4/2010 | Chen et al. |
| 2010/0090101 | A1 | 4/2010 | Schultz et al. |
| 2014/0027631 | A1 | 1/2014 | Trimpin |
| 2015/0024428 | A1 | 1/2015 | Jeong et al. |
| 2015/0053854 | A1 | 2/2015 | Trimpin |
| 2017/0348872 | A1 | 12/2017 | Suzuki et al. |
| 2020/0303176 | A1 | 9/2020 | Uematsu et al. |

FOREIGN PATENT DOCUMENTS

| | | |
|---|---|---|
| JP | 2005-510745 | 4/2005 |
| JP | 2014-206389 | 10/2014 |
| JP | 2015-021960 | 2/2015 |
| JP | 6455588 | 12/2018 |
| JP | 6607770 | 11/2019 |
| JP | 2020-160046 | 10/2020 |
| WO | 2012/058248 A2 | 5/2012 |

OTHER PUBLICATIONS

Kerri J. Grove, et al., "Matrix Pre-Coated MALDI MS Targets for Small Molecule Imaging in Tissues", Journal of the American Society for Mass Spectrometry, vol. 22, No. 1, Jan. 1, 2011, 8 pages, XP055275596.

Kamila Chughtai , et al., "Mass Spectrometric Imaging for Biomedical Tissue Analysis", Chemical Reviews, American Chemical Society, US, vol. 110, No. 5, May 12, 2010, pp. 3237-3277, XP002669351.

* cited by examiner

METHOD, DEVICE, AND BASE FOR PREPARING MEASUREMENT SAMPLE FOR MALDI MASS SPECTROMETRY

CROSS-REFERENCE TO RELATED APPLICATIONS

The present application claims priority under 35 U.S.C. § 119 to Japanese Patent Application No. 2020-050881 filed Mar. 23, 2020 and Japanese Patent Application No. 2021-033985 filed Mar. 4, 2021. The contents of which are incorporated herein by reference in their entirety.

BACKGROUND OF THE INVENTION

Field of the Invention

The present disclosure relates to a method, device, and base for preparing a measurement sample for MALDI mass spectrometry.

Description of the Related Art

Mass spectroscopy is an analytical method where a sample containing a target molecule is ionized to separate and detect ions derived from the target molecule with a mass-to-charge ratio (m/z), and information related to identification of a chemical structure of the target molecule is obtained.

Ionization of a sample of mass spectroscopy is a factor determining the quality of analysis, and numerous methods of ionization have been developed. Examples include matrix assisted laser desorption/ionization (MALDI) and electrospray ionization (ESI). Since ionization is easily performed in these methods even with a very small amount of a sample, these methods have been used in technical fields such as biotechnology and medicines.

In MALDI, a pulsed laser is applied to an area of a matrix including a sample, where the matrix is a material for assisting ionization of the sample, and the sample is ionized together with the matrix.

Light having wavelengths of the ultraviolet region is often used as such a pulsed laser, and light having wavelengths matched with light absorption properties of the matrix is preferable. Moreover, the matrix is a crystalline organic low-molecular-weight molecules, and needs to be co-crystalized with or formed into a mixture with the sample. It has been considered that homogeneousness or a degree of mixing of the co-crystal affects sensitivity or accuracy of analysis. Therefore, matrices have been developed correspondingly to samples.

Moreover, various methods for applying a matrix to a sample have been proposed. For example, proposed is a method for preparing a sample of mass spectroscopy where a matrix is vapor-deposited to form microcrystals, and a matrix solution is further sprayed to the microcrystals to make matrix crystals grow on the microcrystals (see, for example, Japanese Unexamined Patent Application No. 2014-206389).

SUMMARY OF THE INVENTION

According to one aspect of the present disclosure, a method for preparing a measurement sample for MALDI mass spectrometry includes applying a laser beam to a base including a matrix used for preparing the measurement sample for MALDI mass spectrometry, the matrix being disposed on a surface of the base. The laser beam is applied to a surface of the base opposite to the surface including the matrix, to make the matrix fly from the base to be disposed at a predetermined position of an analyte of MALDI mass spectrometry. The base includes a laser energy absorbable material. Laser energy of the laser beam has a wavelength of 400 nm or longer.

Figure 1A:
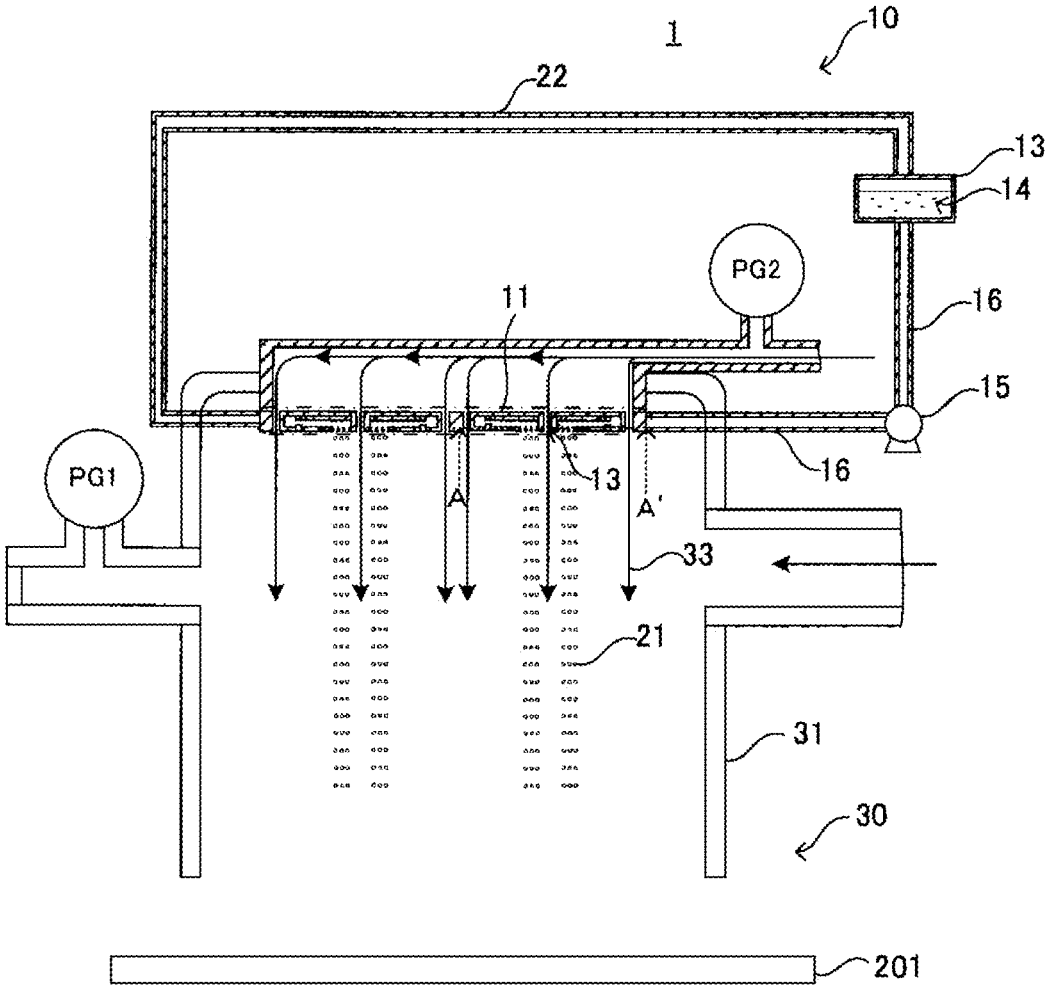
FIG. 1A is a schematic view illustrating an example of a powder forming device as a whole.

DETAILED DESCRIPTION OF THE INVENTION (Method and Device for Preparing Measurement Sample for MALDI Mass Spectrometry)

A method of the present disclosure for preparing a measurement sample for MALDI mass spectrometry includes a step of applying a laser beam to a base including a matrix used for preparing the measurement sample for MALDI mass spectrometry, the matrix being disposed on a surface of the base, in a manner that the laser beam is applied to a surface of the base opposite to the surface including the matrix, to make the matrix fly from the base to be disposed at a predetermined position of an analyte of MALDI mass spectrometry, wherein the base includes a laser energy absorbable material and laser energy of the laser beam has a wavelength of 400 nm or longer. If necessary, the method of the present disclosure further includes other steps.

A device of the present disclosure for preparing a measurement sample for MALDI mass spectrometry is a device for preparing a measurement sample for MALDI mass spectrometry used in the method of the present disclosure for preparing a measurement sample for MALDI mass spectrometry. The device includes a unit configured to apply a laser beam to a surface of the base and, if necessary, further includes other units.

The present disclosure has an object to provide a method for preparing a measurement sample for MALDI mass spectrometry, where the method is able to dispose two or more kinds of matrices on one sample in mass spectrometry using MALDI, and further perform MALDI mass spectrometry with small variation.

In the present disclosure, it is possible to provide a method for preparing a measurement sample for MALDI mass spectrometry, where the method is able to dispose two or more kinds of matrices on one sample in mass spectrometry using MALDI, and further perform MALDI mass spectrometry with small variation.

MALDI is an abbreviation of Matrix Assisted Laser Desorption/Ionization, which is one of methods of mass spectrometry.

In mass spectroscopy using the MALDI (which is referred to as "MALDI mass spectrometry" hereinafter), mass spectroscopy is performed by applying a pulsed laser to a position of a sample to which a matrix, which is a material for assisting ionization, is deposited to thereby ionize the sample together with the matrix.

The matrix for use is selected for components to be analyzed in the sample.

The method and device of the present disclosure for preparing a measurement sample for MALDI mass spectrometry have been accomplished based on the finding that only one kind of a matrix can be disposed according to methods known in the art, such as a method where a matrix is applied to a sample by a spray gun, and a method where a matrix is applied to a sample through gas-phase spray or vapor deposition. In other words, the method of the present disclosure has been accomplished based on the finding that although there are optimum matrices for components to be analyzed, the methods known in the art cannot separately apply such optimum matrices to a plurality of components to be analyzed in one sample.

Also, the methods known in the art for preparing a measurement sample for MALDI mass spectrometry is inefficient because they dispose only one kind of a matrix onto the entire sample, and they need the number of samples corresponding to matrices for a plurality of measurement targets in a sample.

The method of the present disclosure for preparing a measurement sample for MALDI mass spectrometry has been accomplished based on the finding that diameters of crystals of a matrix tend to be uneven and quantitativity is low, because mass spectroscopy of the method known in the art depends largely on skills of an operator, and therefore sensitivity or accuracy of analysis is largely affected.

The method of the present disclosure for preparing a measurement sample for MALDI mass spectrometry includes applying a laser beam having a wavelength of 400 nm or longer to a base including a laser energy absorbable material and a matrix used for preparing the measurement sample for MALDI mass spectrometry disposed on a surface of the base, in a manner that the laser beam is applied to a surface of the base opposite to the surface on which the matrix is disposed, to make the matrix fly from the base to be disposed at a predetermined position of an analyte of MALDI mass spectrometry.

According to the method of the present disclosure for preparing a measurement sample for MALDI mass spectrometry, even when there is only one sample, a plurality of kinds of matrices suitable for targets to be analyzed, such as a protein, a lipid, and a nucleotide, can be disposed at predetermined positions thereof. Therefore, even when there are a plurality of targets to be analyzed in one sample, the method of the present disclosure for preparing a measurement sample for MALDI mass spectrometry can perform imaging mass spectroscopy with high sensitivity for the targets to be analyzed.

Also, the method of the present disclosure for preparing a measurement sample for MALDI mass spectrometry can make the matrix fly from the base by applying the laser beam having a wavelength of 400 nm or longer (which is in the visible light wavelength region) to the base including the laser energy absorbable material and the matrix disposed on the surface of the base. This makes it possible to prevent change in properties (possible damage) due to application of a high-energy laser beam to a target to be analyzed, to thereby be able to achieve MALDI mass spectrometry with small variation. As used herein, "change in properties" means changes in the structure, molecular weight, etc. of the substance of interest.

One exemplary method for confirming the change in properties is confirming whether the proportion of low-molecular-weight components increases through mass spectrometry.

<Base Including Laser Energy Absorbable Material and Matrix Disposed on Surface of the Base>

The base including a laser energy absorbable material and a matrix disposed on a surface of the base is not particularly limited and may be appropriately selected depending on the intended purpose. Hereinafter, the "base including a laser energy absorbable material and a matrix disposed on a surface of the base" is referred to as a "matrix plate."

The matrix plate includes a laser energy absorbable material, a matrix, and a base.

<<Laser Energy Absorbable Material>>

The laser energy absorbable material is not particularly limited and may be appropriately selected depending on the intended purpose as long as it can absorb energy of a laser beam having a wavelength of 400 nm or longer. It is, for example, a laser energy absorbable material having a transmittance of the laser beam having the wavelength of 60% or less. The transmittance of the laser beam having the wavelength can be measured using a spectrophotometer such as an ultra violet-visible infrared spectrophotometer V-660 (available from JASCO Corporation).

The shape of the laser energy absorbable material is not particularly limited and may be appropriately selected depending on the intended purpose. It is preferably a thin film having an average thickness of 3 μm or less.

A matter forming the laser energy absorbable material is preferably a matter that is inert to the matrix and that has a conductive surface when forming a matrix on the laser energy absorbable material. If it is inert to the matrix, there is not a risk that the laser energy absorbable material causes a chemical reaction with the matrix upon application of the laser beam. If it has a conductive surface when forming a matrix on the laser energy absorbable material, the matrix can be electrostatically coated on the laser energy absorbable material. This makes it possible to form a more uniform matrix and increase the yield of matrix coating.

The matter forming the laser energy absorbable material is not particularly limited and may be appropriately selected depending on the intended purpose. Examples thereof include metals.

Examples of the metals include gold, platinum palladium, and silver. Among them, gold is preferable because it is inert and absorbs a laser beam having a broad wavelength range.

When the laser energy absorbable material is a metal thin film, the average thickness thereof is preferably 20 nm or more but 200 nm or less. When the laser energy absorbable material is such a metal thin film having an average thickness of 20 nm or more but 200 nm or less, it is possible to suppress occurrence of variation in conductivity of the surface and suppress occurrence of variation in the thickness of the matrix when coating the matrix through electrostatic coating.

A method for forming the laser energy absorbable material on the base is, for example, vacuum vapor deposition or sputtering.

<<Matrix>>

The matrix is not particularly limited and may be appropriately selected depending on the intended purpose, as long as the matrix is a material capable of suppressing photodecomposition and thermal decomposition of a sample and suppressing fragmentation (cleavage).

Examples of the matrix include matrices known in the art. Specific examples of the matrix include 1,8-diaminonaphthalene (1,8-DAN), 2,5-dihydroxybenzoic acid (which may be abbreviated as "DHBA" hereinafter), 1,8-anthracenedicarboxylic acid dimethyl ester, leucoquinizarin, anthrarobin, 1,5-diaminonaphthalene (1,5-DAN), 6-aza-2-thiothymine, 1,5-diaminoanthraquinone, 1,6-diaminopyrene, 3,6-diaminocarbazole, 1,8-anthracenedicarboxylic acid, norharmane, 1-pyrenepropylamine hydrochloride, 9-aminofluorene hydrochloride, ferulic acid, dithranol, 2-(4-hydroxyphenylazo)benzoic acid) (HABA), trans-2-[3-(4-tert-butylphenyl)-2-methyl-2-propenylidene]malononitrile)

(DCTB), trans-4-phenyl-3-buten-2-one (TPBO), trans-3-indoleacrylic acid (IAA), 1,10-phenanthroline, 5-nitro-1,10-phenanthroline, α-cyano-4-hydroxycinnamic acid (CHCA), sinapic acid (SA), 2,4,6-trihydroxyacetophenone (THAP), 3-hydroxypicolinic acid (HPA), anthranilic acid, nicotinic acid, 3-aminoquinoline, 2-hydroxy-5-methoxybenzoic acid, 2,5-dimethoxybenzoic acid, 4,7-phenanthroline, p-coumaric acid, 1-isoquinolinol, 2-picolinic acid, 1-pyrenebutanoic acid, hydrazide (PBH), 1-pyrenebutyric acid (PBA), and 1-pyrenemethylamine hydrochloride (PMA). Among the above-listed examples, matrix that is acicular-crystalized is preferable, and for example, 2,5-dihydroxybenzoic acid (DHBA) is preferable.

As the matrix that is made fly from the matrix plate including the base in the method for preparing a measurement sample for MALDI mass spectrometry, one of the above-listed various kinds of the matrices can be selected, but the matrix is preferably two or more kinds of the matrices.

Moreover, two or more kinds of the matrices that are made fly from the matrix plate including the base are preferably disposed on mutually different predetermined positions of the sample for MALDI mass spectrometry. The above-mentioned configuration is advantageous because two or more kinds of matrices can be separately applied in one measurement sample, and two or more kinds of imaging mass spectrometry can be performed on one measurement sample.

A region in which the matrix is to be formed is not particularly limited as long as the region is present on the laser energy absorbable material. A shape, structure, and size thereof may be appropriately selected.

The matrix may coat the laser energy absorbable material entirely or partially.

When the matrix coats the laser energy absorbable material, a region in which the matrix is present may be referred to as a matrix layer.

The average thickness of the matrix is not particularly limited and may be appropriately selected depending on the intended purpose. For example, it is preferably 3 μm or more but 50 μm or less, more preferably 5 μm or more but 30 μm or less. When the average thickness of the matrix is 5 μm or more but 30 μm or less, it is possible to accurately deposit a sufficient amount of the matrix onto a measurement sample in one flying operation.

<<Base>>

A shape, structure, size, material, and other features of the base are not particularly limited and may be appropriately selected depending on the intended purpose.

The shape of the base is not particularly limited and may be appropriately selected depending on the intended purpose, as long as the base includes a matrix on a surface thereof and a laser beam or an optical vortex laser beam can be applied onto a back surface of the base. Examples of a flat-plate base include a glass slide.

The material of the base is not particularly limited and may be appropriately selected depending on the intended purpose, as long as the material of the base transmits a laser beam or an optical vortex laser beam. Among the materials that transmit a laser beam or an optical vortex laser beam, inorganic materials, such as various glass including silicon oxide as a main component, and organic materials, such as transparent heat resistance plastics and elastomers, are preferable in view of transmittance and heat resistance.

A surface roughness Ra of the base is not particularly limited and may be appropriately selected depending on the intended purpose. The surface roughness Ra is preferably 1 μm or less both on a front surface and a back surface of the base in order to suppress refraction scattering of a laser beam or an optical vortex laser beam, and to prevent reduction in energy to be applied to the matrix. Moreover, the surface roughness Ra in the preferable range is advantageous because unevenness in an average thickness of the matrix deposited on the sample can be suppressed, and a desired amount of the matrix can be deposited.

The surface roughness Ra can be measured according to JIS B0601. For example, the surface roughness Ra can be measured by means of a confocal laser microscope (available from KEYENCE CORPORATION) or a stylus-type surface profiler (Dektak150, available from Bruker AXS).

[Production Method of Matrix Plate]

A production method of the matrix plate is not particularly limited and may be appropriately selected depending on the intended purpose. Examples of the production method include a method where a matrix layer crystallized by a powder forming device as described below is placed on a glass slide to produce a matrix plate.

In an exemplified production method of the matrix layer, first, a matrix solution containing a matrix mixed in a solvent is prepared.

The solvent is not particularly limited and may be appropriately selected depending on the intended purpose. Examples of the solvent include TFA, TFA-acetonitrile, THF, and methanol.

Figure 1B:
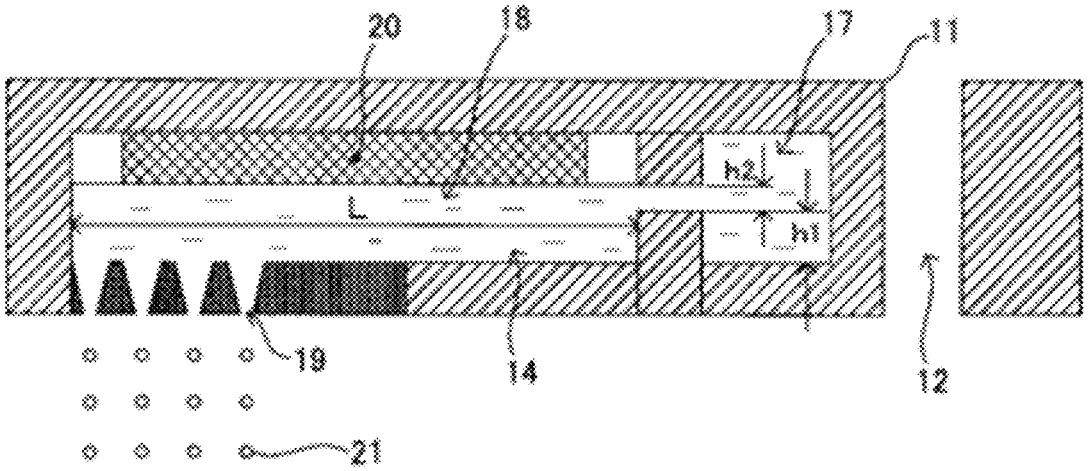
FIG. 1B is a schematic view illustrating a droplet forming head in a droplet forming unit in FIG. 1A.
Figure 1C:
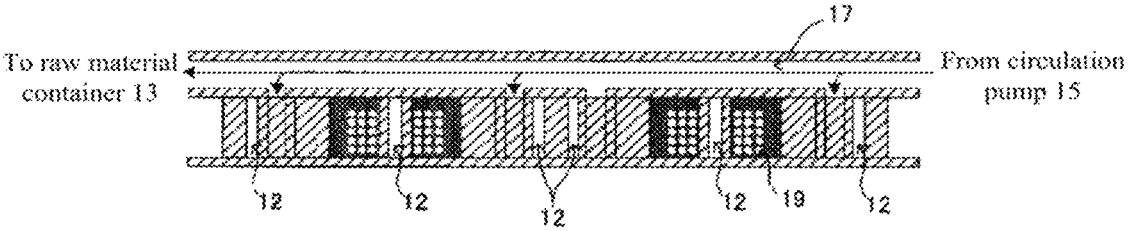
FIG. 1C is a cross-sectional view of a droplet forming unit in FIG. 1A, as taken along line A-A'.

Next, the prepared matrix solution is accommodated in a raw material container 13 of a powder forming device 1 illustrated in FIGS. 1A to 1C.

FIG. 1A is a schematic view illustrating an example of a powder forming device as a whole. FIG. 1B is a schematic view illustrating a droplet forming head in a droplet forming unit in FIG. 1A. FIG. 1C is a cross-sectional view of a droplet forming unit in FIG. 1A, as taken along line A-A'.

The powder forming device 1 illustrated in FIG. 1A includes mainly a droplet forming unit 10 and a dry collection unit 30. The droplet forming unit 10 is a liquid chamber having a liquid jetting region in communication with the outside through discharge holes, and has a plurality of droplet discharge heads 11 aligned, where the droplet discharge heads 11 are a droplet forming unit configured to jet from the discharge holes, droplets of the matrix solution inside a liquid column resonance liquid chamber in which liquid column resonance standing waves are generated under predetermined conditions. Both sides of each droplet discharge head 11 are provided with gas flow passages 12 through each of which a gas flow generated by a gas flow generating unit passes so that droplets of the matrix solution discharged from the droplet discharge head 11 are flown to the side of the dry collection unit 30. Moreover, the droplet forming unit 10 includes a raw material container 13 storing therein a matrix solution 14 that is a matrix raw material, and a liquid circulation pump 15 configured to supply the matrix solution 14 accommodated in the raw material container 13 to the below-mentioned common liquid supply path 17 inside the droplet discharge head 11 through a liquid supply tube 16, and to pump the matrix solution 14 inside the liquid supply tube 16 to return to the raw material container 13 through a liquid returning tube 22. Moreover, the droplet discharge head 11 includes the common liquid supply path 17 and a liquid column resonance liquid chamber 18, as illustrated in FIG. 1B. The liquid column resonance liquid chamber 18 is in communication with the common liquid supply path 17 provided at one of the wall surfaces at both edges in a longitudinal direction. The liquid column resonance liquid chamber 18 includes matrix discharge holes 19 disposed in one of the wall surfaces connected to the wall surfaces at both edges in the longitudinal direction and configured to discharge matrix droplets 21. The liquid column resonance liquid chamber 18 further includes a vibration generating unit 20 disposed at the wall surface facing the matrix discharge holes 19 and configured to generate high frequency vibrations for forming liquid column resonance standing waves. Note that, a high frequency power source is connected to the vibration generating unit 20.

The dry collection unit 30 illustrated in FIG. 1A includes a chamber 31 and a matrix collecting unit (not illustrated). Inside the chamber 31, a gas flow generated by the gas flow generating unit and a downward gas flow 33 are merged to form a large downward gas flow. Matrix droplets 21 jetted from the droplet discharge head 11 of the droplet forming unit 10 are transported downwards by the downward gas flow 33 as well as by the action of gravity, and therefore the jetted matrix droplets 21 are prevented from slowing down due to air resistance. With this configuration, variation in crystal diameters of the matrix droplets 21 is prevented, where the variation would otherwise occur when the matrix droplets 21 are continuously jetted because the traveling speed of previously-jetted matrix droplets 21 is slowed down due to air resistance and subsequently-jetted matrix droplets 21 catch up with the previously-jetted matrix droplet 21 to cause cohesion between the matrix droplets 21. The gas flow generating unit may employ a method where pressurization is performed by disposing a blower at an upstream section or a method where decompression is performed by vacuuming by the matrix collecting unit. The matrix collecting unit includes a rotary gas flow generating device configured to generate a rotary gas flow rotating around an axis parallel to the vertical direction. Powder of the dried and crystalized matrix is born on a base 201 disposed on the bottom of the chamber 31.

The matrix powder obtained in the above-described manner has less variation in crystal diameters, and therefore analysis of high reproducibility becomes possible. Since the matrix powder includes almost no solvent as the solvent is evaporated by drying, biological tissue of the measurement sample is prevented from being destroyed by the solvent of the matrix solution applied to the sample, as seen in the methods known in the art by, for example, spraying. Since almost no solvent is evaporated in performing mass spectrometry, advantageously, the matrix powder can be used to perform mass spectrometry in medical fields or clinical trials, and analysis results can be obtained on-site.

Figure 1D:
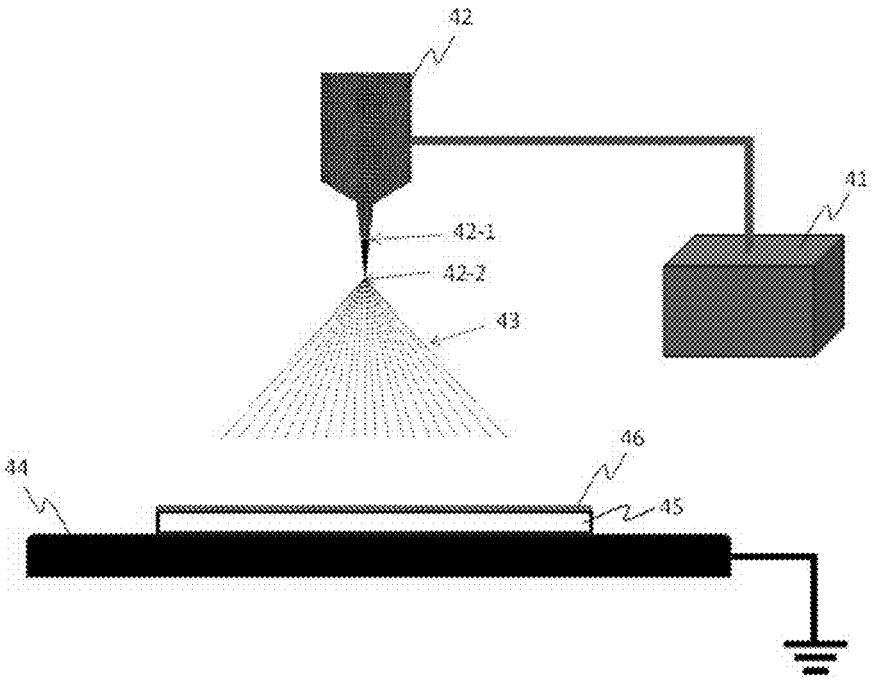
FIG. 1D is a schematic view illustrating one example of coating a matrix onto a base by an electrostatic coating method.

Similarly, a method for forming the matrix layer is suitably a method using, for example, an electrostatic coating device illustrated in FIG. 1D (MICRO MIST COATER, available from Nagase Techno-Engineering Co. Ltd.).

The electrostatic coating device (MICRO MIST COATER) includes a power source 41, a syringe 42, and a coating stage 44.

The electrostatic coating device (MICRO MIST COATER) utilizes a phenomenon of electrospray to form a liquid in the syringe 42 into a mist 42-2 (Rayleigh fission). More specifically, the electrospray is a phenomenon in which a voltage at several thousands of voltages is applied to a liquid in a nozzle 42-1 to form the liquid into a mist. The charged liquid 43 is finely formed into a mist through repulsion by an electrostatic force, and moves towards and adheres onto a conductive surface 46 (laser energy absorbable material) on a base 45 on the coating stage 44.

By use of such electrostatic coating, the matrix solution formed into a fine mist or a powder thereof is attracted to the base by an electrostatic force. This makes it possible to minimize scattering the matrix solution or the powder, leading to a considerable increase in the rate of use of the matrix solution.

Also, the mist lands on the base softly and involves no rebounding after landing, which makes it possible to form a more uniform matrix layer.

Other methods usable for forming the matrix layer are vacuum vapor deposition and sputtering. These methods can form a uniform matrix layer.

A shape of the matrix disposed on the surface of the base is not particularly limited and may be appropriately selected depending on the intended purpose. Examples of the shape of the matrix include a single layer, a multiple layer, and dots.

Among the above-listed examples, when the matrix absorbs the laser having the wavelength, a single layer or dots, or both are preferable. The shape of the matrix being a single layer or clots, or both is advantageous because the matrix can be easily disposed on the surface of the sample.

In the present disclosure, in order to prevent damage to the sample caused by the laser to make the matrix fly, the matrix layer is formed on the laser energy absorbable layer that absorbs the laser having such a wavelength that is not absorbed in the matrix layer.

[Method for Applying Laser Beam to Matrix Plate (Laser Beam Irradiation Unit)]

A method for applying a laser beam to the matrix plate (laser beam irradiation unit) is not particularly limited and may be appropriately selected depending on the intended purpose. For example, the method is preferably a method where a laser beam is applied to the matrix plate by the below-described laser beam irradiation unit.

—Laser Beam Irradiation Unit—

Examples of the laser beam irradiation unit include a unit configured to apply an optical vortex laser beam, a unit configured to apply a uniformly heating irradiation laser beam, and a unit configured to apply a Gaussian laser beam.

Figure 2:
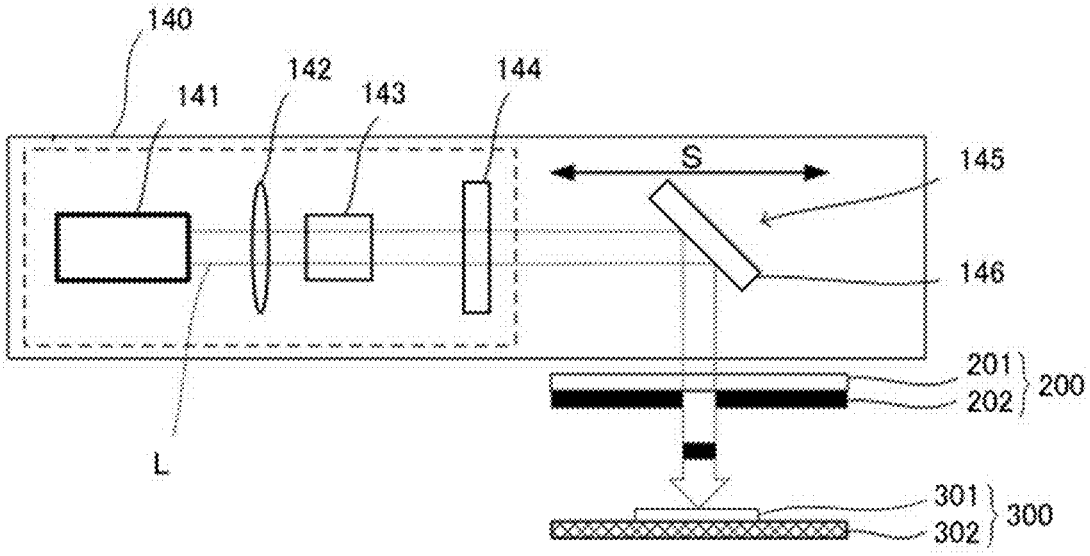
FIG. 2 is a schematic view illustrating an example of a laser beam irradiation unit that can be used in a method of the present disclosure for preparing a measurement sample for MALDI mass spectrometry.

FIG. 2 is a schematic view illustrating an example of a laser beam irradiation unit that can be used in the method of the present disclosure for preparing a measurement sample for MALDI mass spectrometry.

In FIG. 2, the laser beam irradiation unit 140 is configured to apply a laser beam L to a matrix 202 and a laser energy absorbable material born on a base 201, and the matrix 202 and the laser energy absorbable material are made fly by the energy of the laser beam L to deposit the matrix 202 and the laser energy absorbable material on a sample section 301 on a glass slide 302.

The laser beam irradiation unit 140 includes, for example, a laser light source 141, a beam diameter changing unit 142, a beam wavelength changing unit 143, an energy adjusting filter 144, and a beam scanning unit 145. The matrix plate 200 includes the base 201, the matrix 202, and the laser energy absorbable material, and the measurement sample 300 includes the sample section 301 and the glass slide 302.

The laser light source 141 is configured to generate and apply a pulse-oscillated laser beam L to the beam diameter changing unit 142.

Examples of the laser light source 141 include a solid laser, a gas laser, and a semiconductor laser.

The beam diameter changing unit 142 is disposed downstream of the laser light source 141 in an optical path of the laser beam L generated by the laser light source 141, and is configured to change the diameter of the laser beam L.

Examples of the beam diameter changing unit 142 include a condenser lens.

The beam diameter of the laser beam L is not particularly limited and may be appropriately selected depending on the intended purpose. The beam diameter is preferably 20 μm or greater but 300 μm or less. The beam diameter of the laser beam L within the preferable range is advantageous because arrangement of a matrix corresponding to a beam diameter of the existing MALDI becomes possible.

The beam wavelength changing unit 143 is disposed downstream of the beam diameter changing unit 142 in an optical path of the laser beam L, and is configured to change the wavelength of the laser beam L to a wavelength that can be absorbed by the matrix 202 and the laser energy absorbable material.

In the present disclosure, the wavelength of the laser beam L becomes a wavelength that is not absorbed in the matrix 202 and is absorbed in the laser energy absorbable layer.

The beam wavelength changing unit is not particularly limited and may be appropriately selected depending on the intended purpose, as long as, for example, in the case of using the optical vortex laser beam described below, the total torque $J_{L,S}$ represented by the formula (1) below can satisfy the condition $|J_{L,S}|\geq 0$ when circular polarization is given to the laser beam. Examples of the beam wavelength changing unit include a quarter wave plate. In case of the quarter wave plate, oval circular polarization (elliptic polarization) may be given to the below-described optical vortex laser beam by setting an optical axis to an angle other than +45° or −45°, but preferably, circular polarization of a true circle is given to an optical vortex laser beam by setting the optical axis to +45° or −45° to satisfy the condition described above. As a result, the laser beam irradiation unit 140 can increase the effect of stably making the light-absorbing material fly to deposit the light-absorbing material on the deposition target with suppressed scattering.

$$J_{L,S} = \varepsilon_0\left\{\omega LI - \frac{1}{2}\omega Sr\frac{\partial I}{\partial r}\right\} \tag{1}$$

In the formula (1), $\varepsilon_0$ is a dielectric constant in vacuum, ω is an angular frequency of light, L is a topological charge, I is an orbital angular momentum corresponding to the degree of vortex of a laser beam represented by the following mathematical formula (2), S is a spin angular momentum corresponding to circular polarization, and r is a radius vector of the cylindrical coordinates system.

$$I(r) = r^{(2|L|)}\exp\left(-\frac{r^2}{\omega_0^2}\right) \tag{2}$$

In the formula (2), $\omega_0$ is a beam waist size of light.

The topological charge is a quantum number appearing from the periodic boundary condition of the orientation direction in the cylindrical coordinates system of the laser beam. The beam waist size is the minimum value of the beam diameter of the laser beam.

L is a parameter determined by the number of turns of the spiral wavefront in the wave plate. S is a parameter determined by the direction of circular polarization in the wave plate. L and S are both integers. The symbols L and S represent directions of spiral; i.e., clockwise and anticlockwise, respectively.

When the total torque of the optical vortex laser beam is J, the relationship J=L+S is established.

Examples of the beam wavelength changing unit 143 include KTP crystals, BBO crystals, LBO crystals, and CLBO crystals.

The energy adjusting filter 144 is disposed downstream of the beam wavelength changing unit 143 in an optical path of the laser beam L, and is configured to transmit and convert the laser beam L to appropriate energy for making the matrix 202 fly. Examples of the energy adjusting filter 144 include an ND filter, and a glass plate.

The beam scanning unit 145 is disposed downstream of the energy adjusting filter 144 in an optical path of the laser beam L, and includes a reflector 146.

The reflector 146 is movable in a scanning direction presented with an arrow S in FIG. 2 by a reflector driving unit, and is configured to reflect the laser beam L to an arbitrary position of the matrix 202 and the laser energy absorbable material born on the base 201.

The matrix 202 and the laser energy absorbable material are irradiated with the laser beam L having passed through the energy adjusting filter 144, and receives energy in the range of the diameter of the laser beam L to fly onto the sample section 301.

The laser beam L is not particularly limited and may be appropriately selected depending on the intended purpose. Examples of the laser beam L include an optical vortex laser beam, a uniformly heating irradiation laser beam, and a Gaussian laser beam. Among the above-listed examples, an optical vortex laser beam is preferable because the optical vortex laser beam has such properties that can enhance robustness of conditions for transferring a sample without scattering a matrix. The laser beam L being an optical vortex laser beam is advantageous because the flying matrix 202 and laser energy absorbable layer are deposited on the sample section 301 while preventing the matrix 202 and laser energy absorbable layer from being scattered to the periphery by virtue of the Gyroscopic effect given by the optical vortex laser beam.

The optical vortex laser beam can be obtained by converting the Gaussian laser beam. The conversion to the optical vortex laser beam can be performed using, for example, a diffractive optical element, a multi-mode fiber, or a liquid crystal phase modulator.

—Optical Vortex Laser Beam—

The optical vortex laser beam will be described.

Figure 10A:
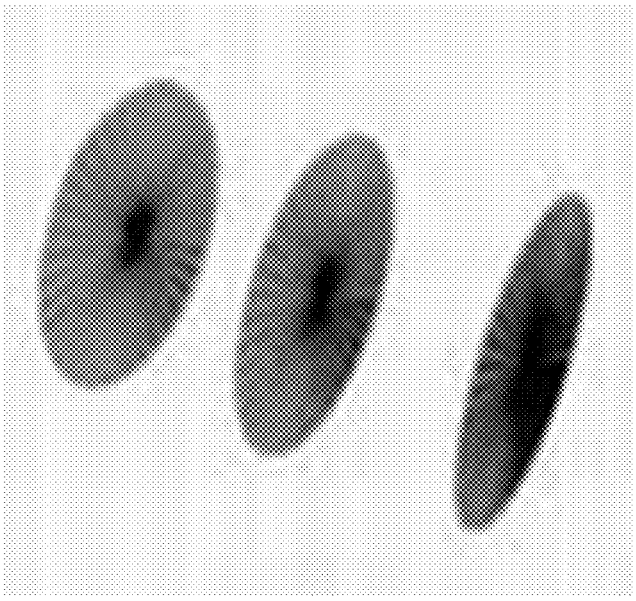
FIG. 10A is a schematic view illustrating one example of a wavefront (equiphase surface) of a typical laser beam.
Figure 10B:
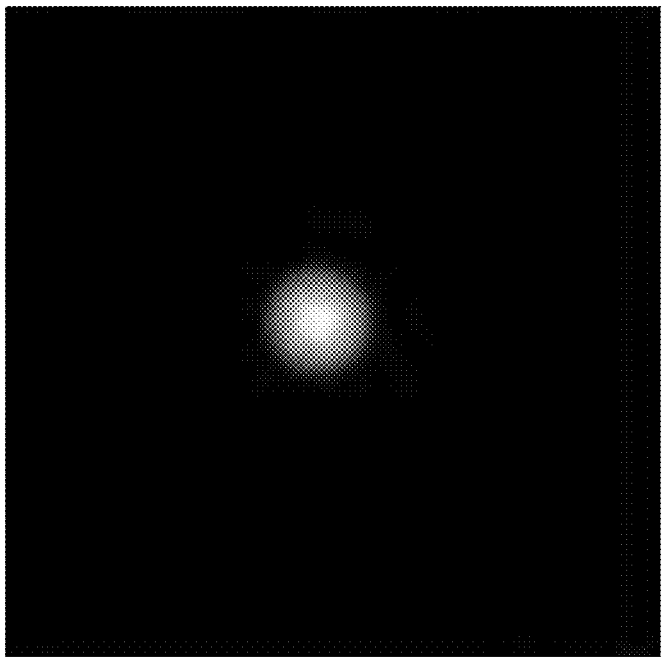
FIG. 10B is a view illustrating one example of a light intensity distribution of a typical laser beam.
Figure 10C:
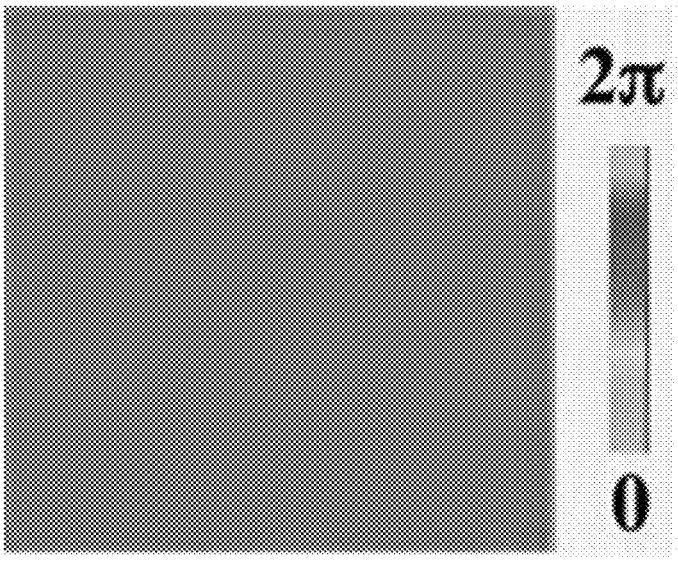
FIG. 10C is a view illustrating one example of a phase distribution of a typical laser beam.

Since a typical laser beam has uniform phases, the laser beam has a planar equiphase surface (wavefront) as depicted in FIG. 10A. The direction of the pointing vector of the laser beam is the orthogonal direction of the planar equiphase surface. Accordingly, the direction of the pointing vector of the laser beam is identical to the irradiation direction of the laser beam. When the light-absorbing material is irradiated with the laser beam, therefore, a force acts on the light-absorbing material in the irradiation direction. However, the light intensity distribution in the cross-section of the layer beam is a normal distribution (Gaussian distribution) where light intensity is the maximum at the center of the beam as depicted in FIG. 10B. Therefore, the light-absorbing material tends to be scattered. Observation of the phase distribution confirms that there is no phase difference as depicted in FIG. 10C.

Figure 11A:
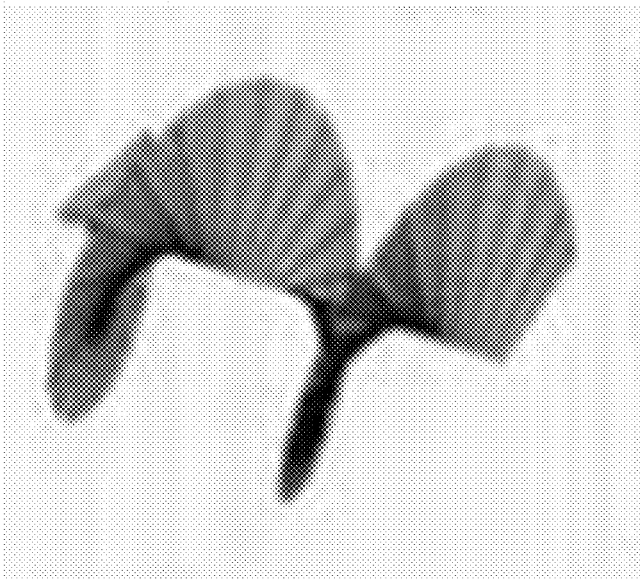
FIG. 11A is a schematic view illustrating one example of a wavefront (equiphase surface) of an optical vortex laser beam.
Figure 11B:
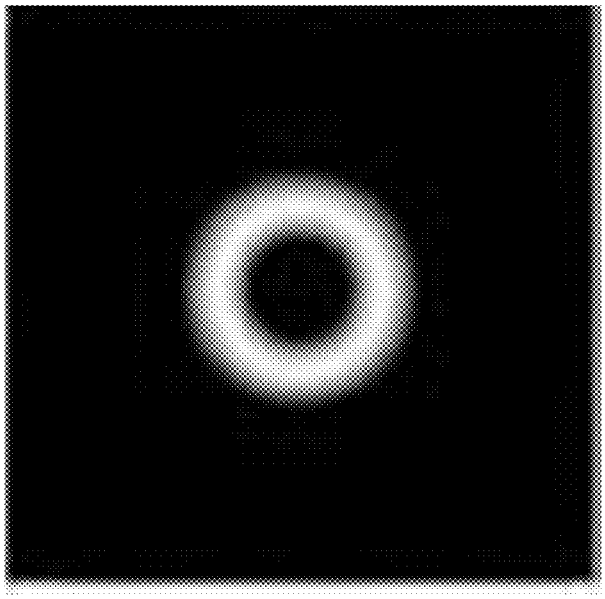
FIG. 11B is a view illustrating one example of a light intensity distribution of an optical vortex laser beam.
Figure 11C:
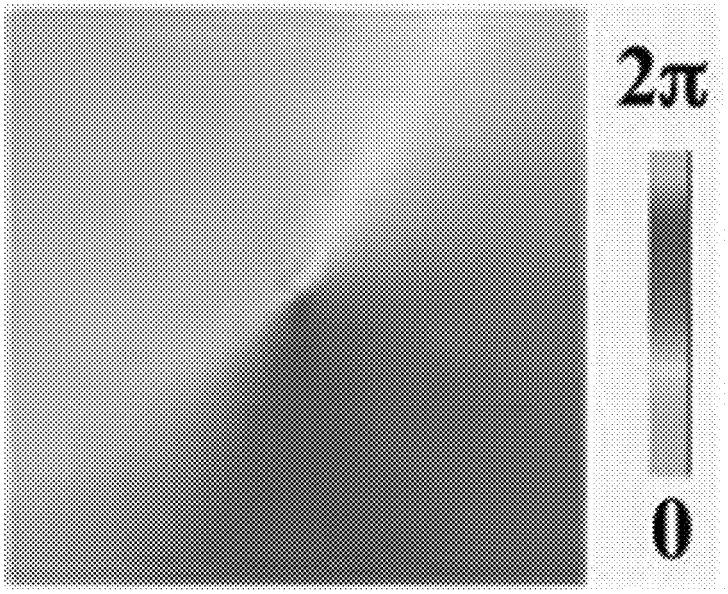
FIG. 11C is a view illustrating one example of a phase distribution of an optical vortex laser beam.

On the other hand, an optical vortex laser beam has a spiral equiphase surface as depicted in FIG. 11A. The direction of the pointing vector of the optical vortex laser beam is a direction orthogonal to the spiral equiphase surface. When the light-absorbing material is irradiated with the optical vortex laser beam, a force acts in the orthogonal direction. The light intensity distribution is a doughnut-shaped distribution where the center of the beam is 0 and recessed as depicted in FIG. 11B. The doughnut-shaped energy is applied as radiation pressure to the light-absorbing material irradiated with the optical vortex laser beam. As a result, the light-absorbing material irradiated with the optical vortex laser beam is made fly in the irradiation direction of the optical vortex laser beam and is then deposited on a deposition target with a less degree of scattering. Observation of the phase distribution confirms that a phase difference occurs as depicted in FIG. 11C.

A method for determining whether the laser beam is an optical vortex laser beam is not particularly limited and may be appropriately selected depending on the intended purpose. Examples of the method include observation of the above-described phase distribution, and measurement of interference. The measurement of interference is typically used.

The measurement of interference can be performed using a laser beam profiler (e.g., a laser beam profiler available from Ophir-Spiricon, Inc., or a laser beam profiler available from Hamamatsu Photonics K.K.). Examples of the results of the measurement of interference are depicted in FIGS. 11D and 11E.

Figure 11D:
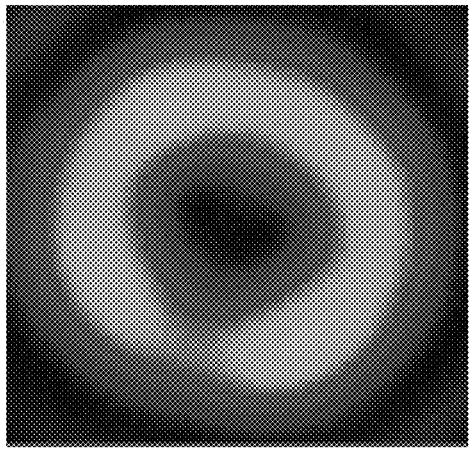
FIG. 11D is a view illustrating one example of results of interference measurement in an optical vortex laser beam.
Figure 11E:
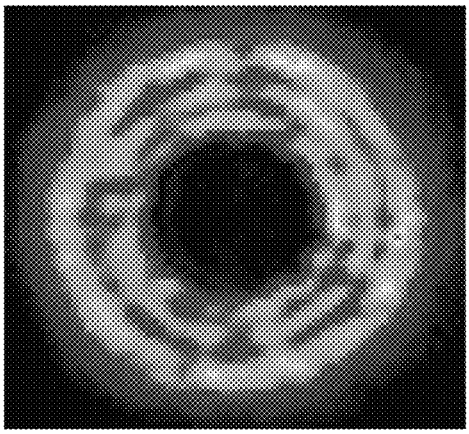
FIG. 11E is a view illustrating one example of results of interference measurement in a laser beam having a point of light intensity of 0 at the center thereof.

FIG. 11D is an explanatory view illustrating one example of a result of measurement of interference in an optical vortex laser beam. FIG. 11E is an explanatory view illustrating one example of a result of measurement of interference in a laser beam having a point of light intensity of 0 at the center thereof.

Figure 9A:
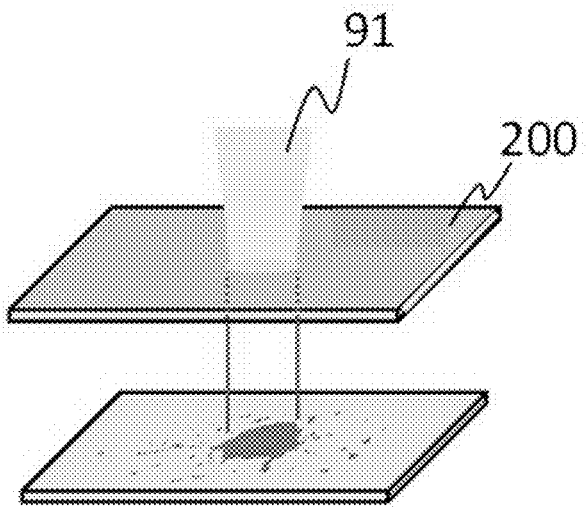
FIG. 9A is a conceptual view illustrating one example of a preparation method of a measurement sample for MALDI mass spectrometry using a typical laser beam.
Figure 9B:
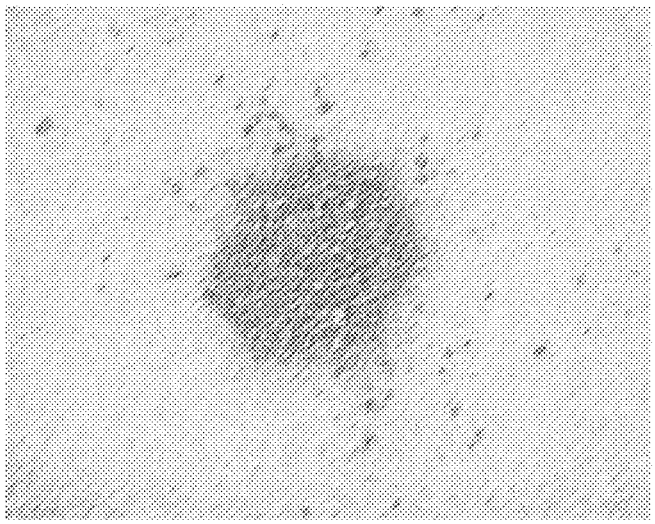
FIG. 9B is a photograph depicting one example of a preparation method of a measurement sample for MALDI mass spectrometry using a typical laser beam.
Figure 9C:
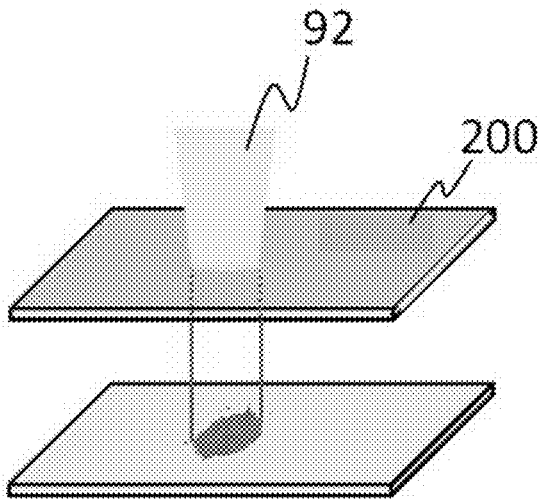
FIG. 9C is a conceptual view illustrating one example of a preparation method of a measurement sample for MALDI mass spectrometry using an optical vortex laser beam.

It can be confirmed from the measurement of interference in the optical vortex laser beam that the energy distribution is a doughnut shape as depicted in FIG. 11D, and the optical vortex laser beam is a laser beam having a point of light intensity of 0 at the center thereof, similar to FIG. 9C.

On the other hand, the measurement of interference in the typical laser beam having a point of light intensity of 0 at the center thereof gives a difference from the optical vortex laser beam. Specifically, the doughnut-shaped energy distribution of the typical laser beam is not uniform as depicted in FIG. 11E although it is similar to the energy distribution obtained by the measurement of interference in the optical vortex laser beam depicted in FIG. 11D.

The laser beam L being an optical vortex laser beam is advantageous because the flying matrix 202 is deposited on the sample section 301 while preventing the matrix 202 from being scattered to the periphery by virtue of the Gyroscopic effect given by the optical vortex laser beam.

The laser beam can be converted into the optical vortex laser beam using, for example, a diffractive optical element, a multi-mode fiber, or a liquid crystal phase modulator.

—Uniformly Heating Irradiation Laser Beam—

Next, the uniformly heating irradiation laser beam will be described below.

The uniformly heating irradiation laser beam is a laser beam that causes a uniformly heated region exhibiting an almost uniform temperature distribution equal to or higher than the melting point of a flying target material (the laser energy absorbable material and the matrix) at the interface between the base and the flying target material (the laser energy absorbable material and the matrix). By applying such a laser beam that causes a uniformly heated region exhibiting an almost uniform temperature distribution equal to or higher than the melting point of a flying target material (the laser energy absorbable material) at the interface between the base and the flying target material (in particular, the laser energy absorbable material), a binding force (intermolecular force) at the interface between the base and the flying target material decreases, so that the flying target material is made fly as powder or debris.

Here, the phenomenon that "causes a uniformly heated region exhibiting an almost uniform temperature distribution equal to or higher than the melting point of a flying target material at the interface between the base and the flying target material" in the uniformly heating irradiation laser beam will be described in detail with reference to the drawings.

The "uniformly heated region" means a region where the temperature distribution of the flying target material becomes almost uniform.

The "region where the temperature distribution of the flying target material becomes almost uniform" means a region of the flying target material disposed on the base where the temperature of the flying target material is not ununiform and becomes almost the same.

When the flying target material is a homogeneous material, it is important that the temperature (energy) distribution of the laser beam to be applied becomes almost uniform, in order to cause the "region where the temperature distribution of the flying target material becomes almost uniform". The temperature (energy) distribution of the laser beam to be applied being almost uniform will be described with reference to the drawings. In the following, a laser beam where the temperature (energy) distribution of the laser beam to be applied is almost uniform may be referred to as a "uniformly heating irradiation laser beam".

Figure 12A:
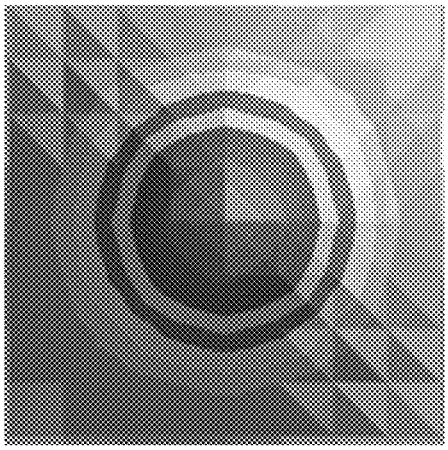
FIG. 12A is a view illustrating one example of a simulation image in which a temperature (energy) distribution of a Gaussian laser beam is represented by contour lines.
Figure 13:
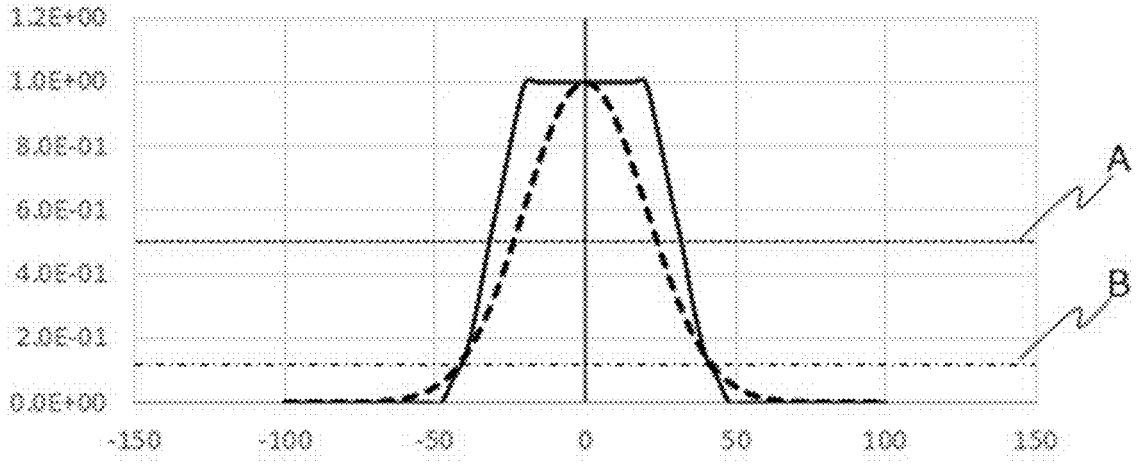
FIG. 13 is a view illustrating one example of cross-sectional intensity distributions of a Gaussian laser beam (a dotted line) and a uniformly heating irradiation laser beam (a solid line)

FIG. 12A is a view illustrating one example of a simulation image in which the temperature (energy) distribution of a commonly used Gaussian laser beam in the cross section perpendicular to the traveling direction of the laser beam is represented by contour lines. As illustrated in FIG. 12A, the Gaussian laser beam has a temperature (energy) distribution where the highest energy intensity is at the center (optical axis) of the laser beam and the energy intensity becomes lower towards the periphery in the cross section perpendicular to the traveling direction of the laser beam. FIG. 13 is a view illustrating one example of energy intensity distributions of the Gaussian laser beam (a dotted line) and the uniformly heating irradiation laser beam (a solid line) in the cross section perpendicular to the traveling direction of the laser beam. Like in FIG. 12A, it is found from FIG. 13 that for the Gaussian laser beam (a dotted line), the energy intensity is the maximum value at the center (optical axis) of the laser beam and the energy intensity becomes lower towards the periphery. Incidentally, the "energy intensity distribution of the laser beam in the cross section perpendicular to the traveling direction of the laser beam" may be referred to simply as a "cross-sectional intensity distribution of the laser beam".

Figure 12B:
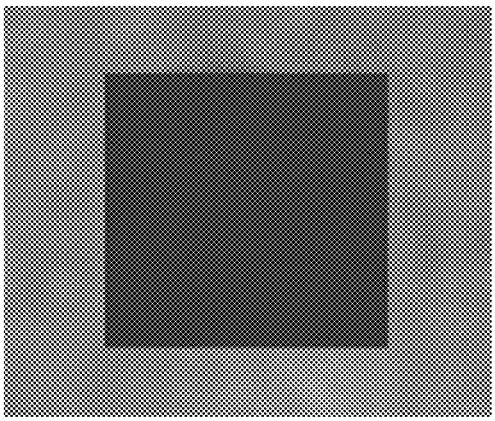
FIG. 12B is a view illustrating one example of an image representing a temperature (energy) distribution of a uniformly heating irradiation laser beam.

FIG. 12B is a view illustrating one example of an image representing the temperature (energy) distribution of the uniformly heating irradiation laser beam. As illustrated in FIG. 12B, in the uniformly heating irradiation laser beam, a region with energy (a black region in the figure) and a region without energy (a gray region in the figure) are clearly divided. Also, as illustrated in FIG. 13, it is found that the uniformly heating irradiation laser beam (a solid line) has an energy intensity distribution where the energy intensity of the laser beam is almost the same, differing from the Gaussian laser beam where the maximum value of energy is at the optical axis. Incidentally, a laser beam having a cross-sectional intensity distribution where the energy intensity of the laser beam is almost the same as described above may be referred to as a top-hat laser beam.

Hitherto, it is known that a top-hat laser beam is used for laser patterning of a thin film, but application of the top-hat laser beam in the LIFT method is not known (see, for example, Japanese Unexamined Patent Application No. 2012-143787).

It is ideal that in the uniformly heating irradiation laser beam, the energy intensity of the laser beam is the same. Specifically, an ideal laser beam is a laser beam whose energy is almost uniform (almost constant) in the cross section perpendicular to the traveling direction of the laser beam.

Figure 14A:
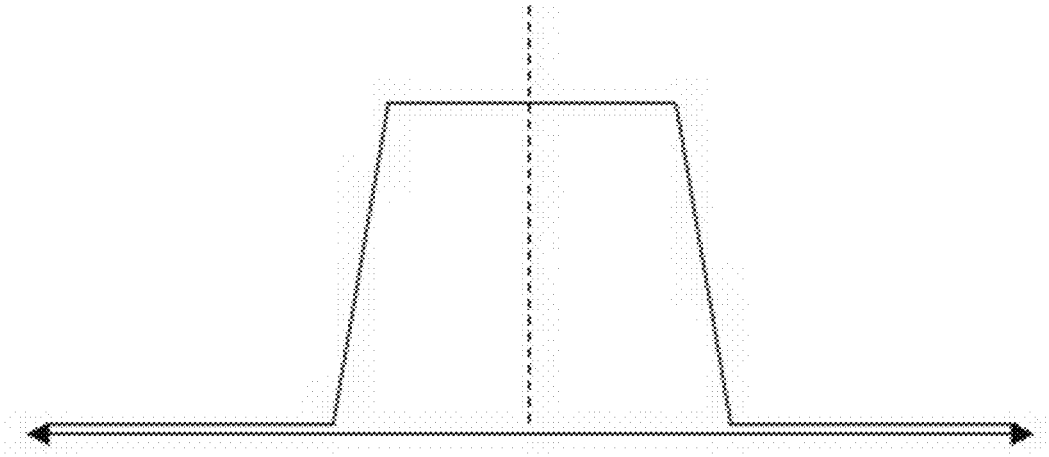
FIG. 14A is a view illustrating one example of a cross-sectional intensity distribution of a uniformly heating irradiation laser beam.
Figure 14B:
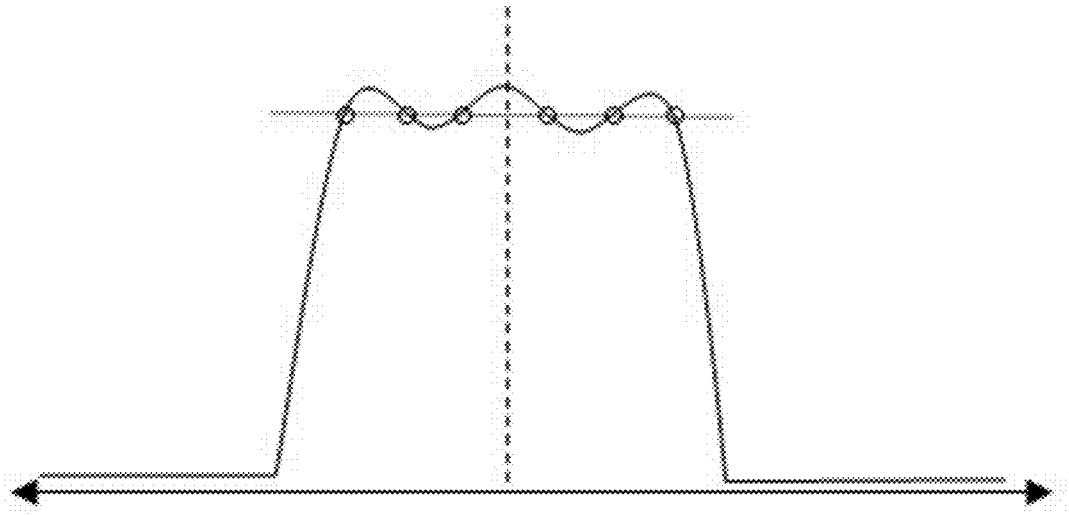
FIG. 14B is a view illustrating another example of a cross-sectional intensity distribution of a uniformly heating irradiation laser beam.

Here, FIG. 14A is a view illustrating one example of the cross-sectional intensity distribution of the uniformly heating irradiation laser beam. FIG. 14B is a view illustrating another example of the cross-sectional intensity distribution of the uniformly heating irradiation laser beam. As illustrated in FIG. 14A, for example, an ideal uniformly heating irradiation laser beam appear to have the same energy intensity of the laser beam in the cross section perpendicular to the traveling direction of the laser beam. In reality, however, the energy intensity of the laser beam will not completely be constant as illustrated in FIG. 14A. Rather, as illustrated in FIG. 14B, the values of the energy intensity of the laser beam fluctuate, presenting an energy distribution that appears to be undulating. There are three or more points where the energy intensity of the uniformly heating irradiation laser beam is the same in the cross section perpendicular to the traveling direction of the laser beam. For example, in the cross-sectional intensity distribution of the uniformly heating irradiation laser beam illustrated in FIG. 14B, there are six points where the energy intensity of the laser beam is the same. Meanwhile, in the cross-sectional intensity distribution of an ideal Gaussian laser beam illustrated in FIG. 13, the distribution of its energy intensity is a Gaussian distribution, and there are at most only two points where the energy intensity of the laser beam is the same.

Therefore, a laser beam having three or more points where the energy intensity of the laser beam in the cross-sectional intensity distribution of the laser beam is the same can be said otherwise as a laser beam whose energy distribution is almost uniform. In the present disclosure, the uniformly heating irradiation laser beam that forms the "uniformly heated region" mean a laser beam having three or more points where the energy intensity of the laser beam is the same in the cross-sectional intensity distribution of the laser beam.

Whether a laser beam is the uniformly heating irradiation laser beam can be judged by measuring the energy distribution of a laser beam to be applied using a beam profiler, and determining whether there are three points or more where the energy intensity of the laser beam is the same in the cross-sectional intensity distribution of the laser beam.

Next, advantages obtained by performing the LIFT method using the uniformly heating irradiation laser beam will be described with reference to the drawings.

Figure 15A:
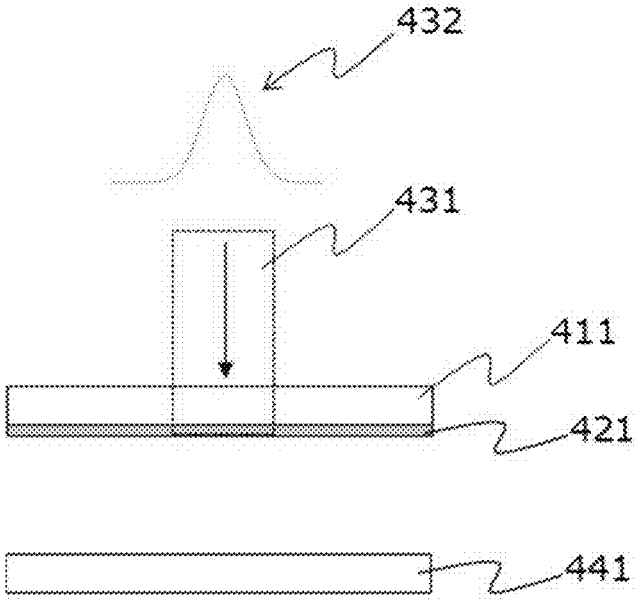
FIG. 15A is a schematic view illustrating one example of a LIFT method using an existing Gaussian laser beam.
Figure 15B:
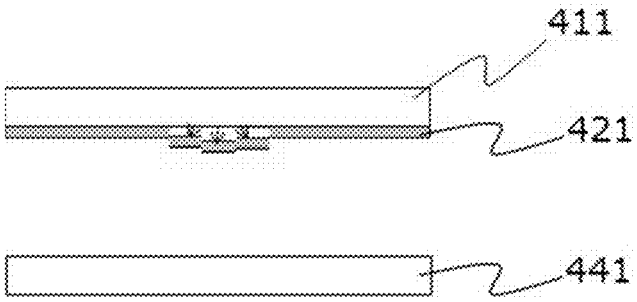
FIG. 15B is a schematic view illustrating another example of a LIFT method using an existing Gaussian laser beam.
Figure 15C:
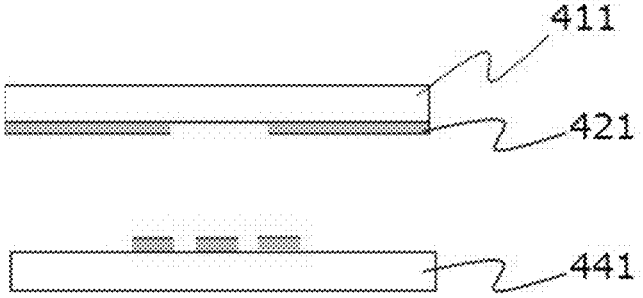
FIG. 15C is a schematic view illustrating still another example of a LIFT method using an existing Gaussian laser beam.
Figure 15D:
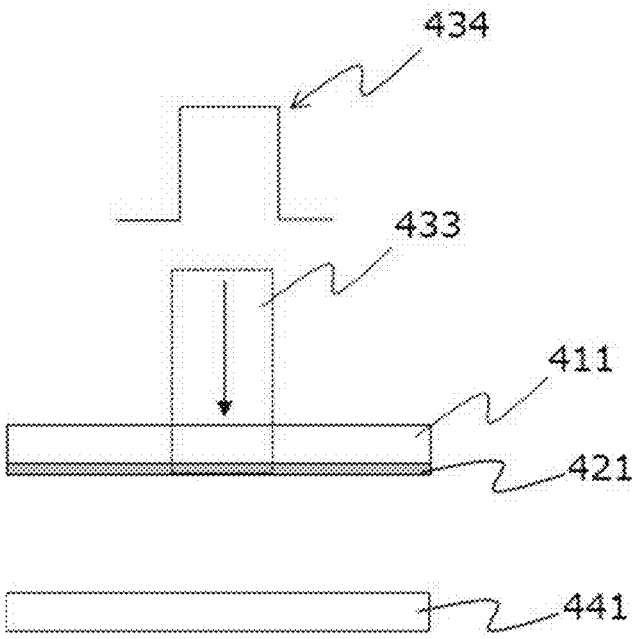
FIG. 15D is a schematic view illustrating one example of a LIFT method using a uniformly heating irradiation laser beam in the present disclosure.
Figure 15E:
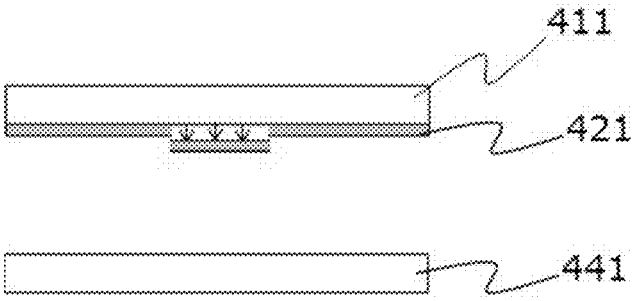
FIG. 15E is a schematic view illustrating another example of a LIFT method using a uniformly heating irradiation laser beam in the present disclosure.
Figure 15F:
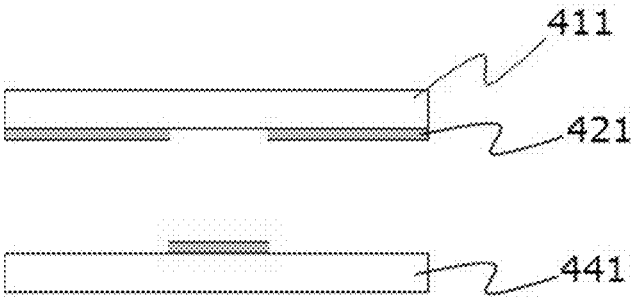
FIG. 15F is a schematic view illustrating still another example of a LIFT method using a uniformly heating irradiation laser beam in the present disclosure.

FIG. 15A to FIG. 15C are schematic views each illustrating one example of the LIFT method using the existing Gaussian laser beam. FIG. 15D to FIG. 15F are schematic views each illustrating one example of the LIFT method using the uniformly heating irradiation laser beam in the present disclosure. In FIG. 15A to FIG. 15F, a transparent base 411 is used as the base and a solid film 421 is used as the flying target material.

FIG. 15A is a schematic view illustrating one example of the case of applying a Gaussian laser beam 431 to the base 411 from the side of a surface of the base opposite to the surface thereof provided with the flying target material 421, which is provided on an at least part of the surface of the base 411. As illustrated in FIG. 15A, when the Gaussian laser beam 431 is applied from the side of the surface of the base opposite to the surface thereof provided with the flying target material 421, the Gaussian laser beam 431 is applied to the flying target material 421 through the base 411. When the Gaussian laser beam 431 is applied to the flying target material 421, the flying target material 421 is heated to a temperature equal to or higher than the melting point thereof by the energy of the laser beam to decrease the binding force (intermolecular force) at the interface between the base 411 and the flying target material 421.

The cross-sectional intensity distribution 432 of the Gaussian laser beam 431 is that the maximum value is at the center of the Gaussian laser beam 431 and the intensity gradually becomes lower towards the periphery. As illustrated in FIG. 15B, therefore, a force tends to be easily generated in the flying target material 421 in a direction from the center of the Gaussian laser beam 431 towards the outside. As a result, as illustrated in FIG. 15C, the flying target material 421 is scattered during flying to attach onto a target 441 sparsely.

FIG. 15D is a schematic view illustrating one example of the case of applying a uniformly heating irradiation laser beam 433 to the base 411 from the side of a surface of the base opposite to the surface thereof provided with the flying target material 421, which is provided on an at least part of the surface of the base 411.

Also in the case of the uniformly heating irradiation laser beam like in the case of the Gaussian laser beam, the laser beam is applied to the flying target material 421 through the base 411, the flying target material 421 is heated to a temperature equal to or higher than the melting point thereof by the energy of the laser beam to decrease the binding force at the interface between the base 411 and the flying target material 421. In the present disclosure, however, the laser beam is applied so as to form a uniformly heated region in the flying target material 421. Specifically, as described above, the uniformly heating irradiation laser beam 433 whose cross-sectional intensity distribution 434 is almost uniform is applied to the flying target material 421. As illustrated in FIG. 15E, a force arises in the flying target material 421 in the same direction as the direction in which the uniformly heating irradiation laser beam 433 is applied. As a result, as illustrated in FIG. 15F, the flying target material 421 flies in the same direction as the direction in which the laser beam is applied, so that the flying target material 421 can attach onto the target 441 without scattering.

Some of the indicators representing the size (width) of a laser beam are "full width at half maximum (FWHM)" and "$1/e^2$ width".

The "full width at half maximum (FWHM)" means the width of a spectrum of a laser beam at half the maximum intensity of the laser beam (e.g., in FIG. 13, the width of the spectrum at an intensity of A).

The "$1/e^2$ width" means an indicator of regarding as a laser beam size (diameter) the distance between two points of the intensity values corresponding to 13.5% of the maximum intensity in the cross-sectional intensity distribution of the laser beam (e.g., in FIG. 13, the width of the spectrum at an intensity of B).

When a ratio of the "full width at half maximum (FWHM)" to the "$1/e^2$ width" is ho (FWHM/($1/e^2$ width)), the ho is "0.6" in an ideal Gaussian laser beam and the ho is "1" in an ideal top-hat beam.

In the case of the Gaussian laser beam, as the energy intensity of the laser beam is higher, an irradiated area at that intensity becomes smaller. Also, the intensity of the Gaussian laser beam becomes higher at a position closer to the center of the laser beam. In other words, the Gaussian laser beam is ununiform in energy intensity in an irradiated region.

Meanwhile, in the uniformly heating irradiation laser beam; i.e., the top-hat beam having the maximum intensity, the ho (FWHM/($1/e^2$ width)) of the "full width at half maximum (FWHM)" to the "$1/e^2$ width" is theoretically "1". The energy intensity of the laser beam is uniform in an irradiated region ("$1/e^2$ width").

According to the present inventors, a laser beam is preferably applied to the flying target material so that the ratio ho (FWHM/($1/e^2$ width)) of the full width at half maximum (FWHM) to the $1/e^2$ width in the energy intensity distribution of the laser beam in the cross section perpendicular to the traveling direction of the laser beam satisfies $0.6<ho<1$, more preferably $0.7\leq ho\leq 0.9$. The ho (FWHM/($1/e^2$ width) of the uniformly heating irradiation laser beam illustrated in FIG. 12B above was found to be 0.85.

In the cross section perpendicular to the traveling direction of the laser beam, a shape of the energy intensity distribution of the uniformly heating irradiation laser beam when the $1/e^2$ width is assumed to be a bottom side is not particular limited and may be appropriately selected depending on the intended purpose. Examples thereof include a square, a rectangle, a parallelogram, a circle, and an oval.

A method for generating the uniformly heating irradiation laser beam is not particular limited and may be appropriately selected depending on the intended purpose. For example, the uniformly heating irradiation laser beam is generated by a uniformly heating irradiation laser beam converting unit.

The uniformly heating irradiation laser beam converting unit is not particularly limited as long as it can causes the above-described uniformly heated region. Examples thereof include an aspherical lens, a phase mask such as a diffractive optical element (DOE), and phase shifting units such as a spatial light modulator (SLM). These may be used alone or in combination.

A method using the aspherical lens is a method geometrically converting the Gaussian laser beam to the uniformly heating irradiation laser beam.

Figure 16A:
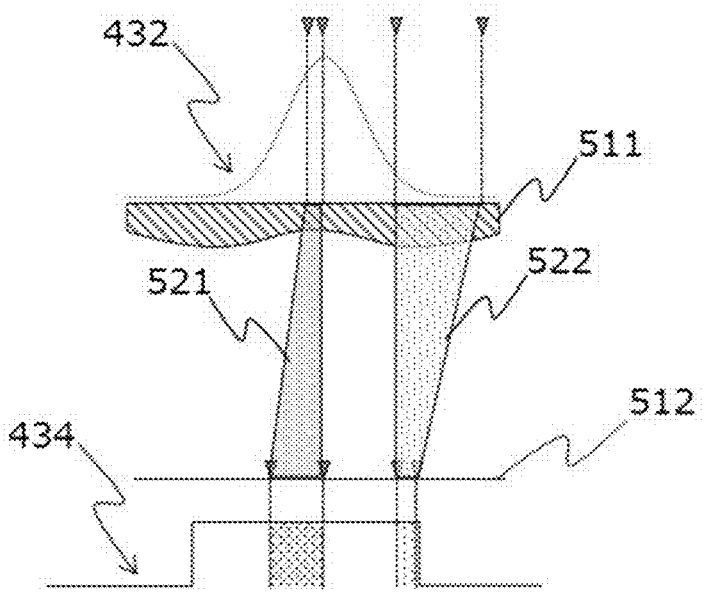
FIG. 16A is a schematic view illustrating one example of adjustment of a uniformly heating irradiation laser beam by a geometric method using an aspherical lens.

FIG. 16A is a schematic view illustrating one example of adjustment of the uniformly heating irradiation laser beam by a geometric method using an aspherical lens. As illustrated in FIG. 16A, a Gaussian laser beam is allowed to pass through an aspherical lens 511 to enlarge the central part 521 of a laser beam having a cross-sectional intensity distribution 432 of the Gaussian laser beam by the effect of a concave lens. A peripheral part 522 of the laser beam is condensed by the effect of a convex lens. On an irradiated surface (base) 512, a laser beam having a cross-sectional intensity distribution 434 of the uniformly heating irradiation laser beam can be provided.

A method using the phase mask such as the diffractive optical element (DOE) is a method wave-optically converting the Gaussian beam to the uniformly heating irradiation laser beam.

Figure 16B:
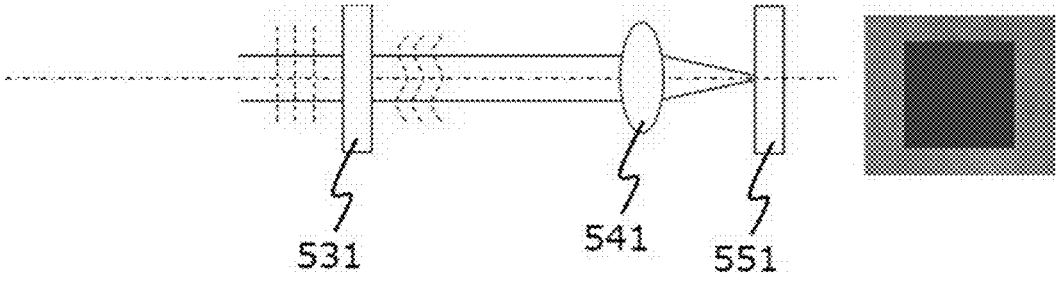
FIG. 16B is a schematic view illustrating one example of adjustment of a uniformly heating irradiation laser beam by a wave optical method using a DOE.

FIG. 16B is a schematic view illustrating one example of adjustment of the uniformly heating irradiation laser beam by a wave optical method using the DOE. As illustrated in FIG. 16B, the Gaussian beam is allowed to pass through a DOE 531 to give a central portion of the laser beam a phase distribution by the effect of a concave lens and give a peripheral part of the laser beam a phase distribution by the effect of a convex lens, to be able to control the wavefront to generate the uniformly heating irradiation laser beam. In FIG. 16B, reference numeral 541 refers to a condenser lens and reference numeral 551 refers to the base.

A method using the phase shifting unit such as the spatial light modulator (SLM) can shift the phase distribution of the laser beam (temporal spatial light modulation). A wavefront of superimposed wavefronts may be changed temporally.

Another usable example than the above is a combination of a reflection-type liquid crystal phase shifting element and a prism.

Figure 16C:
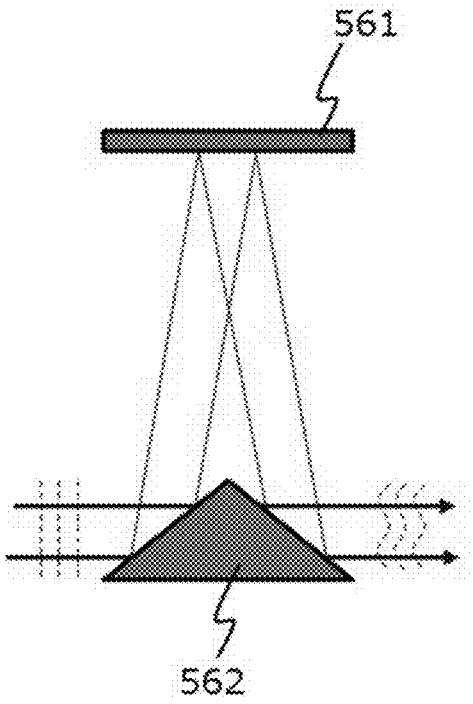
FIG. 16C is a schematic view illustrating one example of adjustment of a uniformly heating irradiation laser beam by a combination of a reflection-type liquid crystal phase shifting element and a prism.

FIG. 16C is a schematic view illustrating one example of adjustment of the uniformly heating irradiation laser beam by the combination of a reflection-type liquid crystal phase shifting element 561 and a prism 562.

By the laser beam converting optical system and the fθ lens, conversion to the uniformly heating irradiation laser beam is performed and the uniformly heating irradiation laser beam is applied onto the flying target material. The size of the laser beam applied onto the base (diameter, $1/e^2$ width) is preferably 20 μm or more but 200 μm or less, more preferably 30 μm or more but 150 μm or less.

When the size of the laser beam is 20 μm or more but 200 μm or less, quality maintenance by laser scanning is made possible to enable high-resolution two- or three-dimensional printing.

Regarding the energy of the uniformly heating irradiation laser beam, the fluence $F_B$ (J/cm$^2$) of the laser beam on the surface on which the flying targeting material is disposed is preferably 20% or higher, more preferably 20% or higher but 80% or lower, of the fluence $F_F$ (J/cm$^2$) of the laser beam on the surface of the base onto which the laser beam is applied.

The fluence (J/cm$^2$) usually refers to a fluence on the incident side (front-side fluence, $F_F$) and is often discussed with the absorption coefficient of a material. According to the studies by the present inventors, however, it is found to be important for flying quality to control the fluence on the film surface opposite to the light-absorbing film irradiated with light (back-side fluence, $F_B$).

Next, an embodiment of the flying object generating device for performing the method of the present disclosure for preparing the measurement sample for MALDI mass spectrometry will be described with reference to the drawings.

Figure 17A:
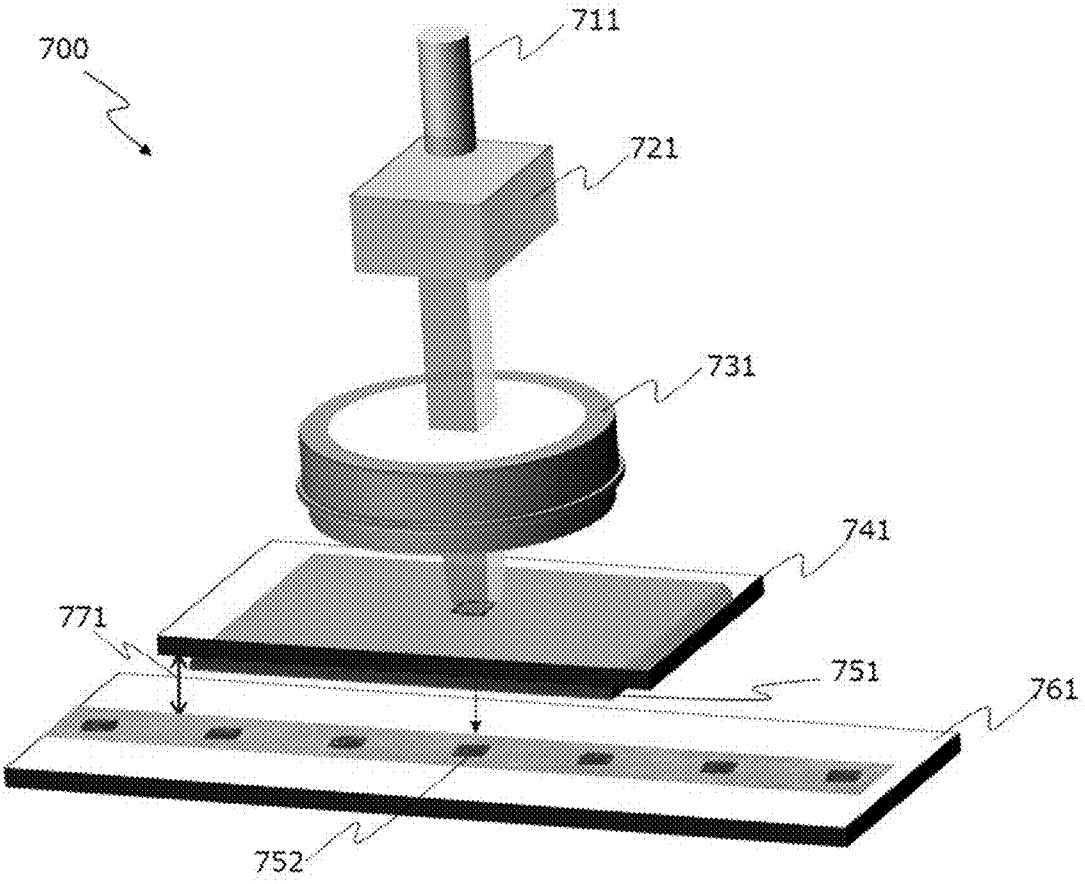
FIG. 17A is a schematic view illustrating one example of a flying object generating device to perform a method of the present disclosure for preparing a measurement sample for MALDI mass spectrometry.

FIG. 17A is a schematic view illustrating one example of the flying object generating device to perform the method of the present disclosure for preparing the measurement sample for MALDI mass spectrometry.

As illustrated in FIG. 17A, a flying object generating device 700 in the present disclosure includes a laser beam 711 emitted from an unillustrated light source, a beam converting optical system 721, and a condensing optical system 731. The flying object generating device 700 is used together with a base 741, a flying target material 751, and an adherent receiving medium 761. The flying object generating device 700 is configured such that the laser beam 711 emitted from the unillustrated light source passes through the beam converting optical system 721 and the fθ as the condensing optical system 731 for conversion to a desired beam profile, and is applied to the flying target material 751 through the base 741. The flying target material 751 after irradiation with the laser beam 711 flies towards the adherent receiving medium 761 provided to face, with an interval (a gap) 771, the flying target material 751 disposed on the base 741, and adhere to the adherent receiving medium 761 (adhered flying target material 752). The interval (gap) 771 between the flying target material 751 and the adherent receiving medium 761 is adjusted with an unillustrated gap retaining unit. The position of the adherent receiving medium 761 in the plane direction can be adjusted by an unillustrated position adjusting unit.

Figure 17B:
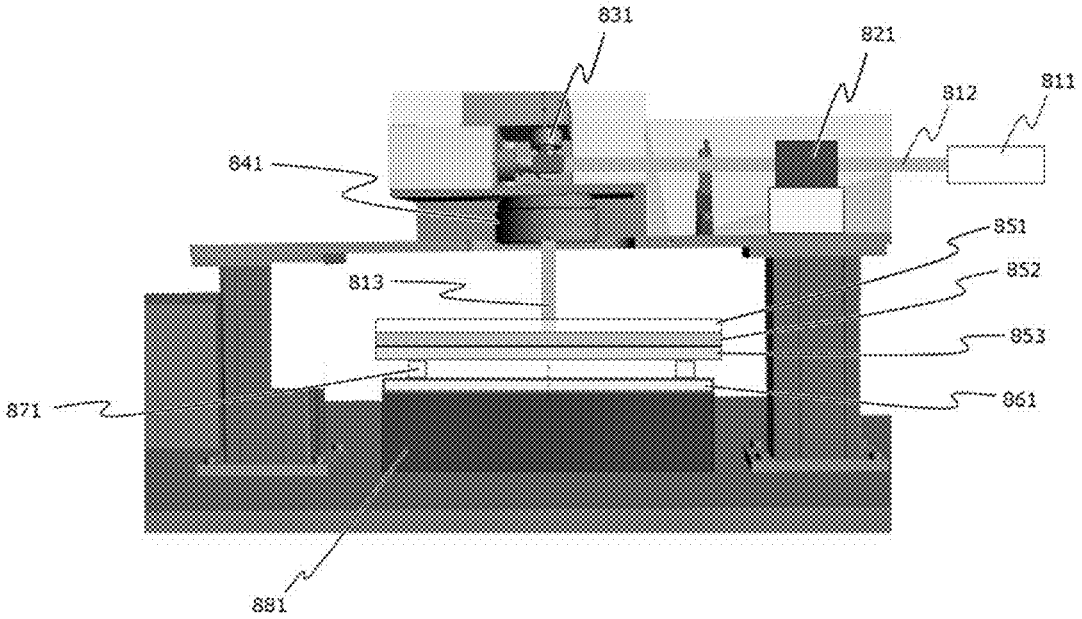
FIG. 17B is a schematic view illustrating another example of a flying object generating device to perform a method of the present disclosure for preparing a measurement sample for MALDI mass spectrometry.

FIG. 17B is a schematic view illustrating another example of a flying object generating device in the present disclosure.

As illustrated in FIG. 17B, the figure is drawn as an axially symmetrical model for the sake of convenience. As illustrated in FIG. 17B, the flying object generating device includes a light source 811, a beam converting optical system 821, an (X-Y) Galvano scanner 831 as a scanning optical system, and a condenser lens 841 as a condensing optical system. The flying object generating device is configured that a sample stage 881 can be provided thereon with a transparent object (base) 851 on at least part of a surface of which a flying object material 853 and a laser energy absorbable material (assist film) 852 are provided. The flying object generating device also includes a gap retaining member 871 configured to provide a gap between the transparent object (base) 851 and the adherent receiving medium (acceptor substrate) 861. The flying object generating device converts a Gaussian beam 812, which is emitted from a light source 811, to a uniformly heating irradiation laser beam 813 in the beam converting optical system 821.

In one example of the flying object generating device illustrated in FIG. 17B, a flying target material flying unit including the light source 811, the beam converting optical system 821, the Galvano scanner 831, and the condenser lens 841 applies a laser beam 813 towards the transparent object (base) 851 from the side of the surface side opposite to the surface on which the a flying target material 853 is disposed, to make the flying target material 853 fly in the direction in which the laser beam 813 is applied. In one example of the flying object generating device illustrated in FIG. 17B, moreover, the flying target material 853 (flying object) made fly adheres to the adherent receiving medium (target) 861.

(Base for Preparing Measurement Sample for MALDI Mass Spectrometry)

A base of the present disclosure for preparing a measurement sample for MALDI mass spectrometry includes a substrate, a laser energy absorbable material that can absorb energy of a laser beam having a wavelength of 400 nm or longer, and a matrix, the laser energy absorbable material being on the substrate, the matrix being on the laser energy absorbable material; and if necessary, further includes other materials.

The base of the present disclosure for preparing a measurement sample for MALDI mass spectrometry is similar to the matrix plate in the method of the present disclosure for preparing a measurement sample for MALDI mass spectrometry.

(Measurement Sample for MALDI Mass Spectrometry)

The measurement sample for MALDI mass spectrometry is not particularly limited and may be appropriately selected depending on the intended purpose, as long as the measurement sample includes an analyte of MALDI mass spectrometry and one or more kinds of matrices disposed on the analyte at predetermined positions thereof. When MALDI mass spectrometry is performed, the measurement sample for MALDI mass spectrometry is desirably placed on a conductive substrate.

In the measurement sample for MALDI mass spectrometry, the matrix can be made fly twice or more from the base to the predetermined positions of the analyte of MALDI mass spectrometry. Making the matrix fly twice or more from the base is advantageous because the amount of the matrix can be adjusted.

<Analyte>

The analyte of MALDI mass spectrometry is not particularly limited and may be appropriately selected depending on the intended purpose, as long as the analyte can be analyzed by MALDI mass spectrometry. Examples of the analyte include frozen brain tissue, whole animal sections, seeds, and printed images.

(MALDI Mass Spectrometry Method)

The MALDI mass spectrometry method of the present disclosure is not particularly limited and may be appropriately selected depending on the intended purpose, as long as the MALDI mass spectrometry method performs MALDI mass spectrometry using the measurement sample of the present disclosure for MALDI mass spectrometry.

The MALDI mass spectrometry method can be performed by, for example, MALDI-TOF-MS (available from Bruker Daltonics).

(Non-Transitory Recording Medium Storing Program for Causing Computer to Prepare Measurement Sample for MALDI Mass Spectrometry)

A non-transitory recording medium of the present disclosure storing a program for causing a computer to prepare a measurement sample for MALDI mass spectrometry, the program causing the computer to execute a process including based on position information of an analyte of MALDI mass spectrometry, applying a laser beam to a base including a matrix used for preparing the measurement sample for MALDI mass spectrometry, the matrix being disposed on a surface of the base, in a manner that the laser beam is applied to a surface of the base opposite to the surface on which the matrix is disposed, to make the matrix fly from the base to be disposed at a predetermined position of the analyte of MALDI mass spectrometry.

The program stored in the non-transitory recording medium of the present disclosure is preferably executed to perform the method of the present disclosure for preparing a measurement sample for MALDI mass spectrometry.

Specifically, the program stored in the non-transitory recording medium of the present disclosure can execute the method of the present disclosure for preparing a measurement sample for MALDI mass spectrometry using, for example, a computer as a hardware resource. The program stored in the non-transitory recording medium of the present disclosure may be executed by one or more computers or servers, or both thereof.

A process by the program stored in the non-transitory recording medium of the present disclosure is performed in the state where a plurality of matrix plates on which mutually different kinds of matrices are disposed are set in predetermined positions in advance, and an ITO-coat glass slide on which a measurement sample is placed is fixed in a predetermined position.

Figure 3A:
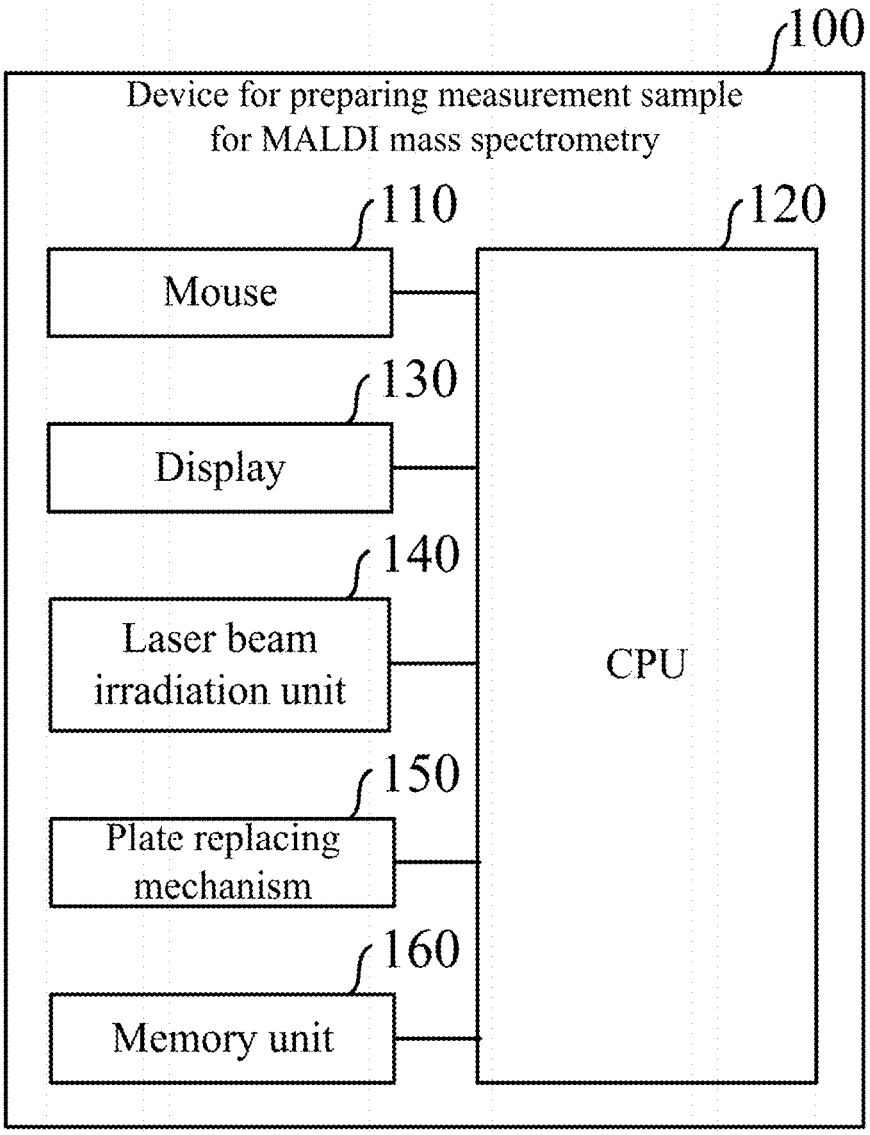
FIG. 3A is a block diagram illustrating an example of hardware of a device for preparing a measurement sample for MALDI mass spectrometry.
Figure 3B:
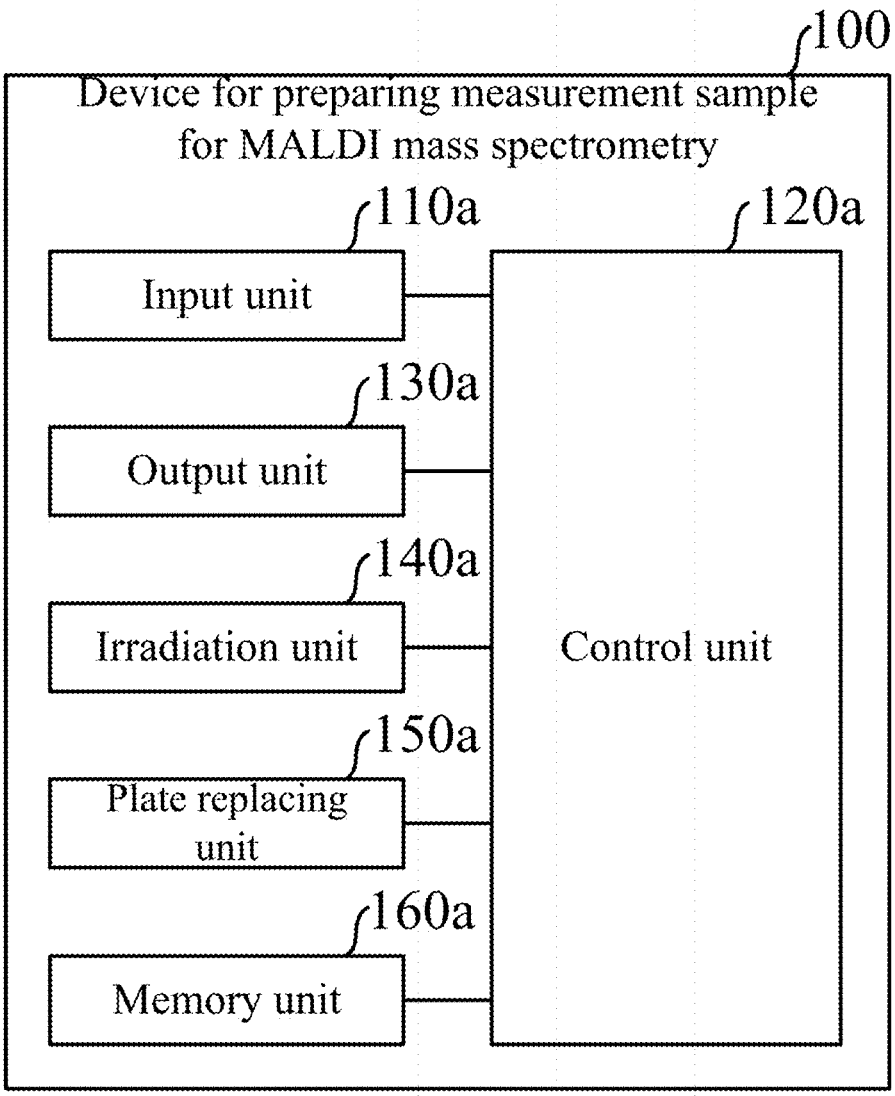
FIG. 3B is a block diagram illustrating an example of a function of the device for preparing a measurement sample for MALDI mass spectrometry.

The process by the program stored in the non-transitory recording medium of the present disclosure can be executed, for example, by a device for preparing a measurement sample for MALDI mass spectrometry as illustrated in FIGS. 3A and 3B.

FIG. 3A is a block diagram illustrating an example of hardware of a device for preparing a measurement sample for MALDI mass spectrometry.

As illustrated in FIG. 3A, a device 100 for preparing a measurement sample for MALDI mass spectrometry includes a mouse 110, a CPU 120, a display 130, a laser beam irradiation unit 140, a plate replacing mechanism 150, and a memory unit 160. The CPU 120 is coupled with each unit.

The mouse 110 is configured to receive irradiation data corresponding information of "a kind of a matrix" to information of "a position of a measurement sample irradiated with a laser beam" from a user with the below-described input unit 110*a*. The mouse 110 is configured to receive another input for the device 100 for preparing a measurement sample for MALDI mass spectrometry.

The CPU 120 is one kind of a processer and is a processing device configured to perform various controls and calculations. The CPU 120 realizes various functions, as the CPU 120 executes, for example, firmware stored in, for example, the memory unit 160. The CPU 120 corresponds to the below-described control unit 120*a*.

The display 130 is configured to display a screen to receive various instructions with the below-described output unit 130*a*.

The laser beam irradiation unit 140 is similar to, for example, the laser beam irradiation unit illustrated in FIG. 2, and can apply a laser beam to a predetermined position of the matrix plate with the below-described output unit 130*a*.

The plate replacing mechanism 150 is a mechanism configured to replace matrix plates, on which various matrices are disposed, stored in the device with the below-described plate replacing unit 150*a*.

The memory unit 160 stores various programs for operating the device 100 for preparing a measurement sample for MALDI mass spectrometry.

FIG. 3B is a block diagram illustrating an example of a function of the device for preparing a measurement sample for MALDI mass spectrometry.

As illustrated in FIG. 3B, the device for preparing a measurement sample for MALDI mass spectrometry 100 includes an input unit 110*a*, a control unit 120*a*, an output unit 130*a*, an irradiation unit 140*a*, a plate replacing unit 150*a*, and a memory unit 160*a*. The control unit 120*a* is coupled with each unit.

The input unit 110*a* is configured to, following the instructions of the control unit 120*a*, receive irradiation data corresponding information of "a kind of a matrix" to information of "a position of a measurement sample irradiated with a laser beam" from a user with the mouse 110.

The receipt of the irradiation data may be performed by, for example, inputting a kind of a matrix and an irradiation position on an image that captures the measurement sample placed on the ITO-coat glass slide.

The input unit 110*a* is configured to receive another input from a user.

The control unit 120*a* is configured to store irradiation data received by the input unit 110*a* in a memory unit 160*a*. The control unit 120*a* is configured to control operations of the entire device 100 for preparing a measurement sample for MALDI mass spectrometry.

The output unit 130*a* is configured to display a screen to receive various instructions on the display 130, following the instructions of the control unit 120*a*.

The irradiation unit 140*a* is configured to operate the laser beam irradiation unit 140, following the instructions of the control unit 120*a*, and can apply a laser beam to a matrix plate disposed by the plate replacing unit 150*a*.

The plate replacing unit 150*a* is configured to replace a matrix plate, following the instructions of the control unit 120*a* based on the irradiation data. The device stores therein a plurality of matrix plates on which mutually different kinds of matrix powder are disposed. The matrix plates are replaced by the plate replacing mechanism 150.

The memory unit 160*a* is configured to, following the instructions of the control unit 120*a*, store, for example, irradiation data received by the input unit 110*a* or various programs in the memory unit 160.

Figure 3C:
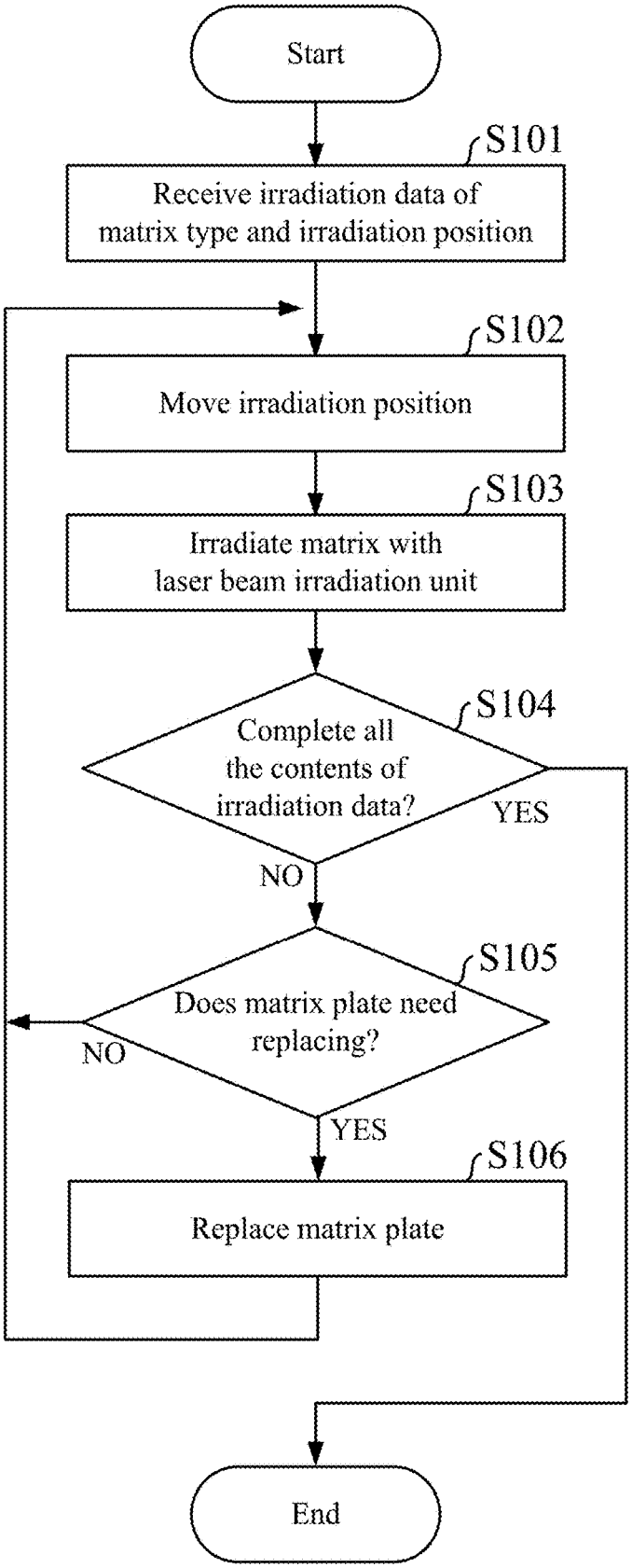
FIG. 3C is a flowchart illustrating an example of a procedure of a program in the present disclosure for preparing a measurement sample for MALDI mass spectrometry.

FIG. 3C is a flowchart illustrating an example of a procedure of the program stored in the non-transitory recording medium of the present disclosure.

In Step S101, the input unit 110*a* receives irradiation data corresponding information of "a kind of a matrix" to information of "a position of a measurement sample irradiated with a laser beam" from a user with the mouse 110, and then moves the process to S102.

In Step S102, the control unit 120*a* moves an irradiation position of the laser beam irradiation unit 140 based on the irradiation data, and then moves the process to S103.

In Step S103, the irradiation unit 140*a* makes a matrix disposed on the matrix plate fly to dispose the matrix on a sample section with the laser beam irradiation unit 140, and then moves the process to S104.

In Step S104, the control unit 120*a* determines whether all of the contents of the irradiation data have been completed. When determining that all of the contents of the irradiation data have been completed, the control unit 120*a* ends the process. When determining that not all of the contents of the irradiation data have been completed, the control unit 120*a* moves the process to S105.

In Step S105, the control unit 120*a* determines whether it is necessary to replace the matrix plate based on the irradiation data. When determining that replacement of the matrix plate is necessary, the control unit 120*a* moves the process to S106. When determining that replacement of the matrix plate is unnecessary, the control unit 120*a* returns the process to S102.

In Step S106, the replacing unit 120 replaces the matrix plate and then returns the process to S102.

As described above, the program stored in the non-transitory recording medium of the present disclosure causes a computer to execute a process including based on position information of an analyte of MALDI mass spectrometry, applying a laser beam to a base including a matrix used for preparing the measurement sample for MALDI mass spectrometry, the matrix being disposed on a surface of the base, in a manner that the laser beam is applied to a surface of the base opposite to the surface on which the matrix is disposed, to make the matrix fly from the base to be disposed at a predetermined position of the analyte of MALDI mass spectrometry.

EXAMPLES

The present disclosure will be described below by way of Examples. The present disclosure should not be construed as being limited to these Examples.

The following presents Examples and Comparative Example, in which a pulse-oscillated laser beam is applied to Matrix A and Matrix B by the laser beam irradiation unit 140 illustrated in FIG. 2 to dispose dots of these two kinds of matrices on one sample section.

Example 1

[Preparation of Matrix Solutions]

<Preparation of Matrix Solution A>

Sinapic acid (SA) as Matrix A was dissolved in THF (obtained from Tokyo Chemical Industry, Co., Ltd.) as a solvent to prepare a sinapic acid THF solution having a solid content of 1% by mass as Matrix Solution A.

<Preparation of Matrix Solution B>

Next, α-cyano-4-hydroxycinnamic acid (HCCA) as Matrix B was dissolved in THF (obtained from Tokyo Chemical Industry, Co., Ltd.) as a solvent to prepare an α-cyano-4-hydroxycinnamic acid THF solution having a solid content of 1% by mass as Matrix Solution B.

<Preparation of Matrix Solution C>

Next, 2,5-dihydroxybenzoic acid (DHB) as Matrix C was dissolved in THF (obtained from Tokyo Chemical Industry, Co., Ltd.) as a solvent to prepare a 2,5-dihydroxybenzoic acid THF solution having a solid content of 1% by mass as Matrix Solution C.

[Preparation of Matrix Plates]

<Preparation of Matrix Plate A>

Figure 4A:
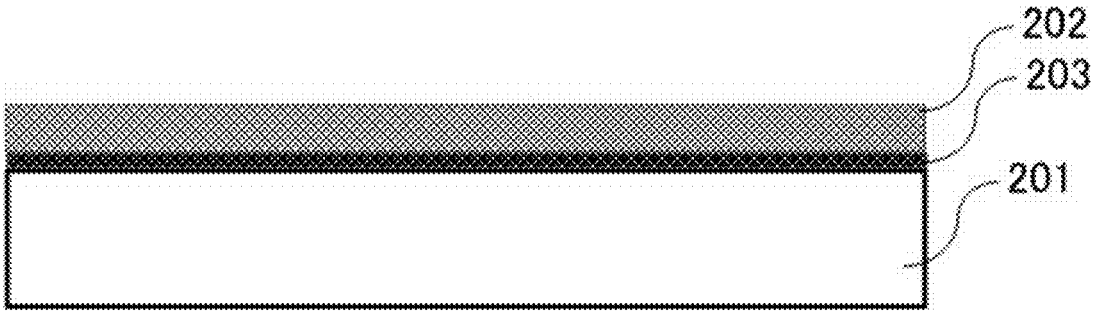
FIG. 4A is a schematic view of a layer configuration of a matrix plate in Examples.

Gold was vacuum vapor-deposited on one surface of a glass slide (S2441, Super frost white, obtained from Matsunami Glass Ind., Ltd.) as a base so as to give an average thickness of 50 nm. On the gold-deposited surface, the prepared Matrix Solution A was formed into powder of Matrix A having an average primary particle diameter of 20 μm in the longer sides of acicular crystals to form a powder layer of Matrix A so as to have an average thickness of 5 μm, using the powder forming technology illustrated in FIGS. 1A to 1C. In this manner, Matrix Plate A having the structure depicted in FIG. 4A was prepared.

<Preparation of Matrix Plate B>

In the same manner as in the preparation of Matrix Plate A except that Matrix Solution A was changed to Matrix Solution B, powder of Matrix B having an average primary particle diameter of 10 μm was formed to form a powder layer of Matrix B so as to have an average thickness of 5 μm. In this manner, Matrix Plate B was prepared.

<Preparation of Matrix Plate C>

In the same manner as in the preparation of Matrix Plate A except that Matrix Solution A was changed to Matrix Solution C, powder of Matrix C having an average primary particle diameter of 15 μm was formed to form a powder layer of Matrix C so as to have an average thickness of 5 μm. In this manner, Matrix Plate C was prepared.

<Preparation of Matrix Plate D>

Figure 4B:
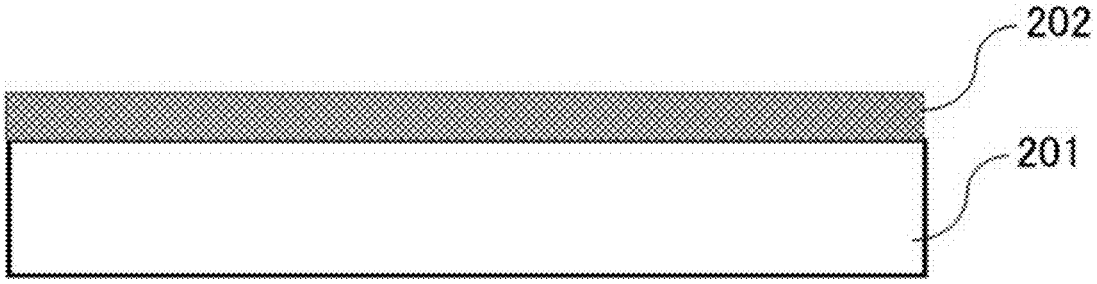
FIG. 4B is a schematic view of a layer configuration of a matrix plate in Examples.

On a surface of a glass slide (S2441, Super frost white, obtained from Matsunami Glass Ind., Ltd.) as a base, the prepared Matrix Solution A was formed into powder of Matrix A having an average primary particle diameter of 20 μm to form a powder layer of Matrix A so as to have an average thickness of 5 μm, using the powder forming technology illustrated in FIGS. 1A to 1C. In this manner, Matrix Plate D having the structure depicted in FIG. 4B was prepared.

<Preparation of Matrix Plate E>

In the same manner as in the preparation of Matrix Plate D except that Matrix Solution A was changed to Matrix Solution B, powder of Matrix B having an average primary particle diameter of 10 μm was formed to form a powder layer of Matrix B so as to have an average thickness of 5 μm. In this manner, Matrix Plate E was prepared.

<Preparation of Matrix Plate F>

In the same manner as in the preparation of Matrix Plate D except that Matrix Solution A was changed to Matrix Solution C, powder of Matrix C having an average primary particle diameter of 15 μm was formed to form a powder layer of Matrix C so as to have an average thickness of 5 μm. In this manner, Matrix Plate F was prepared.

<Preparation of Matrix Plate G>

Gold was vacuum vapor-deposited on one surface of a glass slide (S2441, Super frost white, obtained from Matsunami Glass Ind., Ltd.) as a base so as to give an average thickness of 50 nm. On the gold-deposited base, the prepared Matrix Solution A was formed into powder of Matrix A having an average primary particle diameter of 10 μm to form a powder layer of Matrix A so as to have an average thickness of 5 μm, using the electrostatic coating technology illustrated in FIG. 1D. In this manner, Matrix Plate G having the structure depicted in FIG. 4A was prepared.

<Preparation of Matrix Plate H>

In the same manner as in the preparation of Matrix Plate G except that Matrix Solution A was changed to Matrix Solution B, powder of Matrix B having an average primary particle diameter of 10 μm was formed to form a powder layer of Matrix B so as to have an average thickness of 5 μm. In this manner, Matrix Plate H having the structure depicted in FIG. 4A was prepared.

[Preparation of Standard Sample Group]

First, all of the contents of one vial of Peptide Calibration Standard II as a standard sample was dissolved in 125 μL of a 0.1% THF solvent, followed by stirring with vibration for several seconds.

Figure 5A:
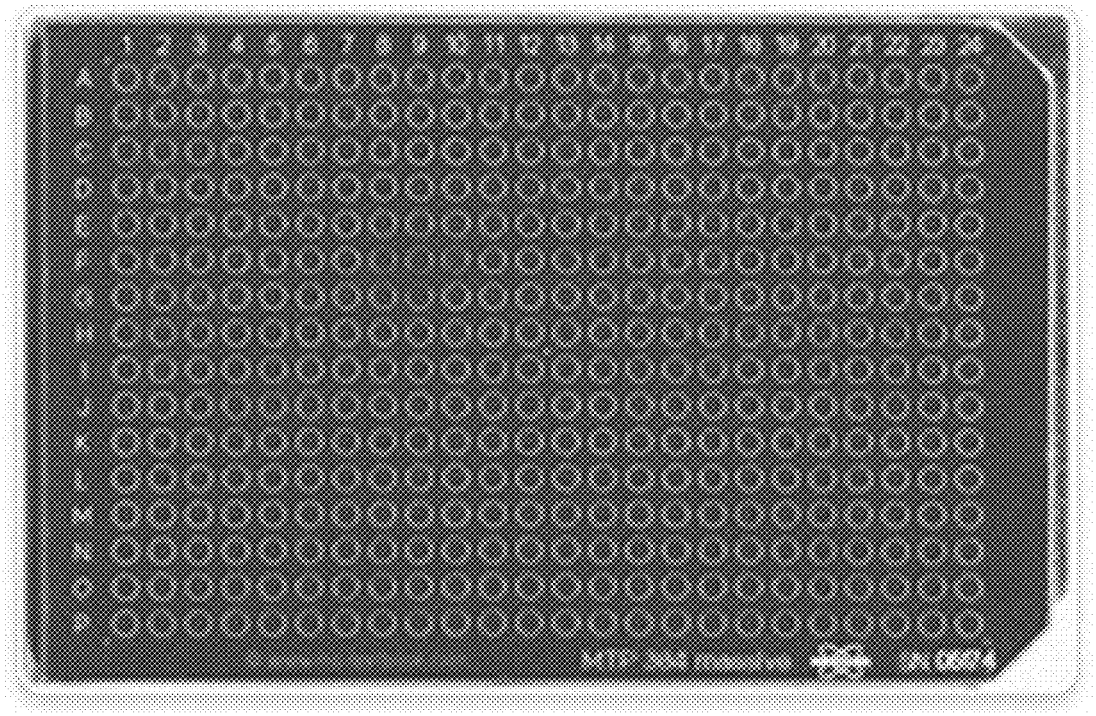
FIG. 5A is a view illustrating one example of a base used in Examples and Comparative Examples.
Figure 5B:
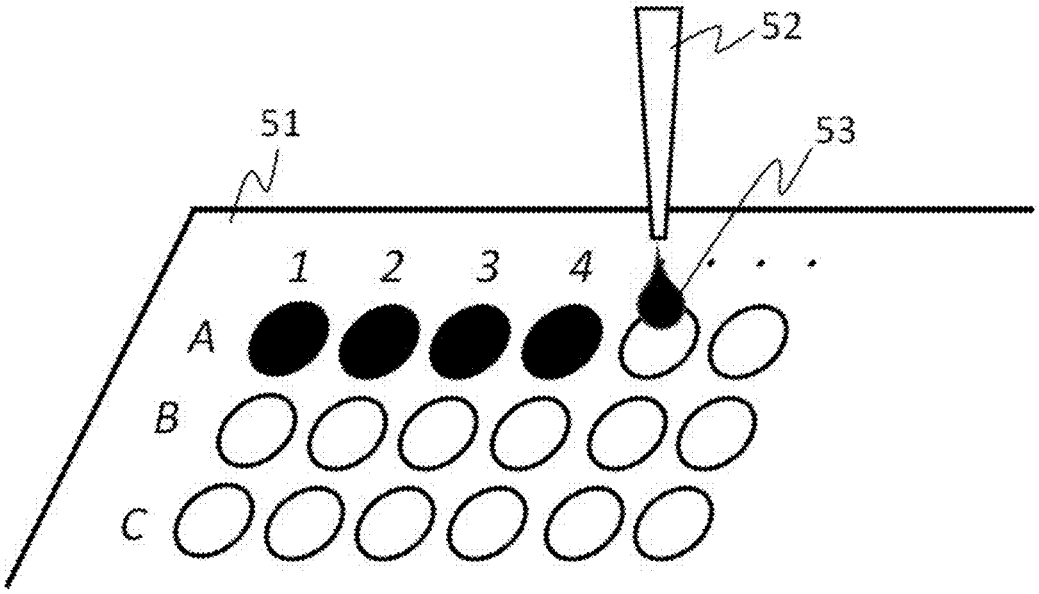
FIG. 5B is a view illustrating one example of a base onto which an analyte is disposed used in Examples and Comparative Examples.

One microliter of the resultant solution 53 was dropped with a micro syringe (FIG. 5B) into each of the circles arranged vertically from A to P and horizontally from 1 to 24 of "MTP384 Target Ground Steel BC" 51 depicted in FIG. 5A, followed by drying, to prepare a standard sample group. The same standard sample group was prepared through the same procedure, to prepare two standard sample groups (standard sample group 1 and standard sample group 2).

[Preparation of Laser Beam Irradiation Units]

<Preparation of Laser Beam Irradiation Unit A>

As a laser beam irradiation unit, the laser beam irradiation unit 140 illustrated in FIG. 2 was used.

Specifically, as a laser beam source, a YAG laser configured to excite YAG crystals to oscillate laser was used. The laser beam source was used to generate a one-pulse laser beam having a wavelength of 1,064 nm, a beam diameter of 1.25 mm×1.23 mm, a pulse width of 2 nano seconds, and a pulse frequency of 20 Hz. The generated one-pulse laser beam was applied to a condenser lens (YAG laser condenser lens, obtained from SIGMAKOKI CO., LTD.) serving as a beam diameter changing member to adjust a beam diameter of the laser beam to be applied to a matrix to 100 μm×100 μm. The laser beam having passed through the beam diameter changing member was applied to a LBO crystal (obtained from CESTEC) serving as the beam wavelength changing element to change the wavelength from 1,064 nm to 532 nm. The laser beam was passed through an energy adjusting filter (ND filter, obtained from SIGMAKOKI CO., LTD.) so that the laser output upon application to a matrix was adjusted to 50 μJ/dot.

<Preparation of Laser Beam Irradiation Unit B>

Laser beam irradiation unit B was the same as Laser beam irradiation unit A except for the following changes. Specifically, the laser beam converted by the wavelength changing unit was passed through a vortex phase plate (Vortex phase plate, obtained from Luminex Corporation) to convert into an optical vortex laser beam. Next, the optical vortex laser beam converted by the vortex phase plate was passed through a quarter wave plate (QWP, obtained from Kogakugiken Corp.) disposed downstream of the vortex phase plate. The optical axis of the vortex phase plate and the optical axis of the quarter wave plate were set to +45° so that the total torque J represented by Formula (1) would be 2. The converted optical vortex laser beam was passed through an energy adjusting filter (ND filter, obtained from SIGMAKOKI CO., LTD.) so that the laser output upon application to a matrix was adjusted to 50 μJ/dot.

<Preparation of Laser Beam Irradiation Unit C>

Laser beam irradiation unit C was the same as Laser beam irradiation unit B except for the following changes. Specifically, the laser beam of 1,064 nm and the laser beam of 532 nm were used in a LBO crystal to make a change to a laser beam of 355 nm using a wavelength changing unit configured to perform sum-frequency generation.

<Preparation of Laser Beam Irradiation Unit D>

Laser beam irradiation unit D used was a laser irradiation unit exemplified in FIG. 17A or FIG. 17B. A laser having a wavelength of 1,064 nm emitted from a Nd:YAG laser light source was allowed to pass through a spatial isolator, a λ/4 plate, and a collimator lens. An acousto-optic modulator (AOM) was used to control the frequency of the laser light source by temporally separating it into the zero-order light and the first-order light based on ON/OFF signals from a PC and a controller. The zero-order light was cut off when passing through the mirror and the lens. Only the first-order light passes through a nonlinear optical crystal (SHG element), and a second harmonic wave (SHG) was generated by the nonlinear optical effect, to generate green light having a wavelength of 532 nm.

Next, harmonic separator HS was used to separate it into a fundamental wave and a second harmonic wave, to obtain a laser beam of green as a single color (Green light).

The obtained Green light was corrected for phase distribution and intensity distribution by aberration correction and a vertical and horizontal scaling element, and was passed through a zoom lens so as to enter the laser beam converting unit illustrated in FIG. 16A configured for conversion to the uniformly heating irradiation laser beam.

After that, the light passed through the mirror, ND, and other optical elements, and was reflected by a light polarizer such as a Galvano mirror, to that the laser output was 50 μJ/dot upon application to the matrix via a condenser lens (focal length: 100 mm).

[Preparation of Measurement Sample Group for MALDI Mass Spectrometry]

Example 1

Figure 6A:
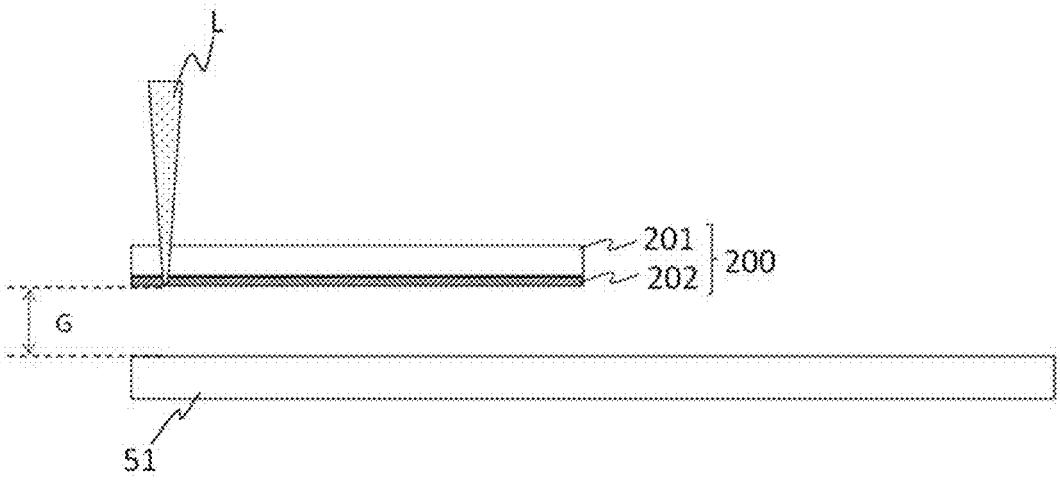
FIG. 6A is a schematic view illustrating preparation of a measurement sample for MALDI mass spectrometry in Examples.

As illustrated in FIG. 6A, the powder layer (202) of Matrix A formed on the surface of Matrix Plate A (200) was allowed to face the sample surface of the standard sample group 1 so that a Gaussian laser beam could be vertically applied from Laser beam irradiation unit A to the back surface of Matrix Plate A (the surface including no matrix). In FIG. 6A, although unillustrated, the laser energy absorbable material was disposed between the powder layer (202) of Matrix A and the base 201 in Matrix Plate A (200). The gap between the standard sample section and the powder layer of Matrix G was set to 100 μm.

Figure 6B:
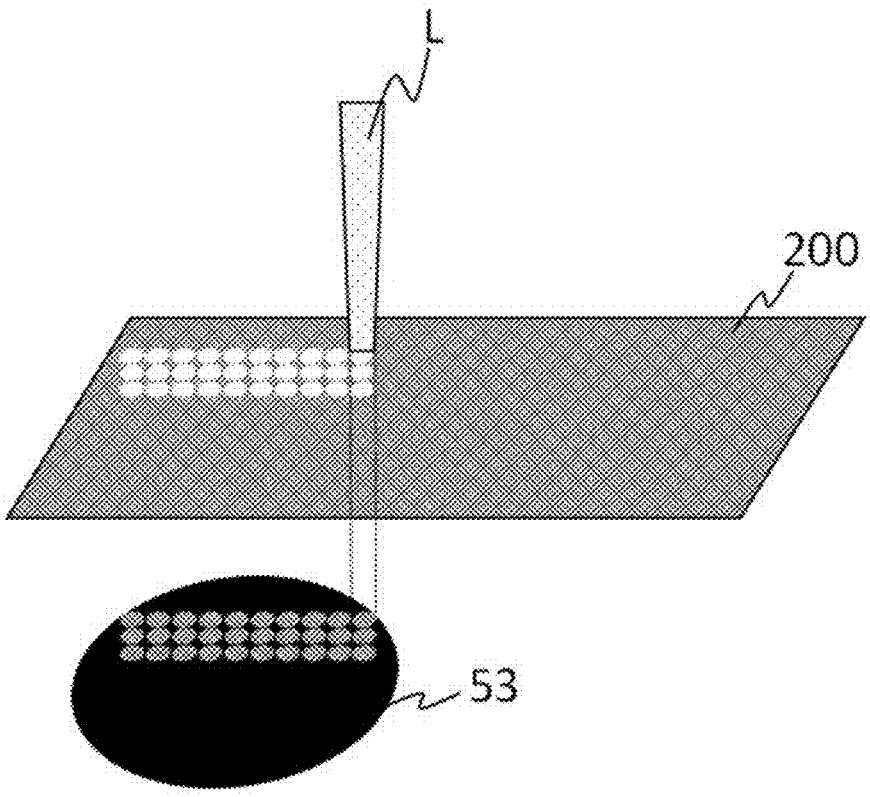
FIG. 6B is a schematic view illustrating preparation of a measurement sample for MALDI mass spectrometry in Examples.
Figure 6C:
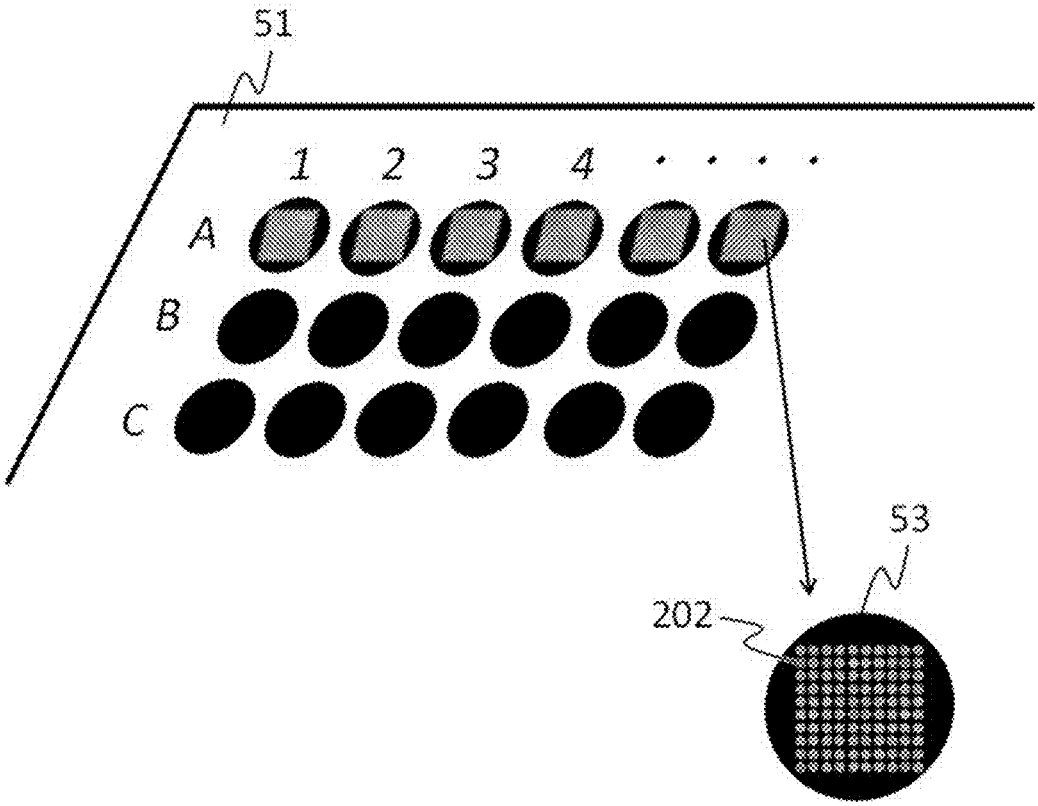
FIG. 6C is a schematic view illustrating preparation of a measurement sample for MALDI mass spectrometry in Examples.
Figure 7A:
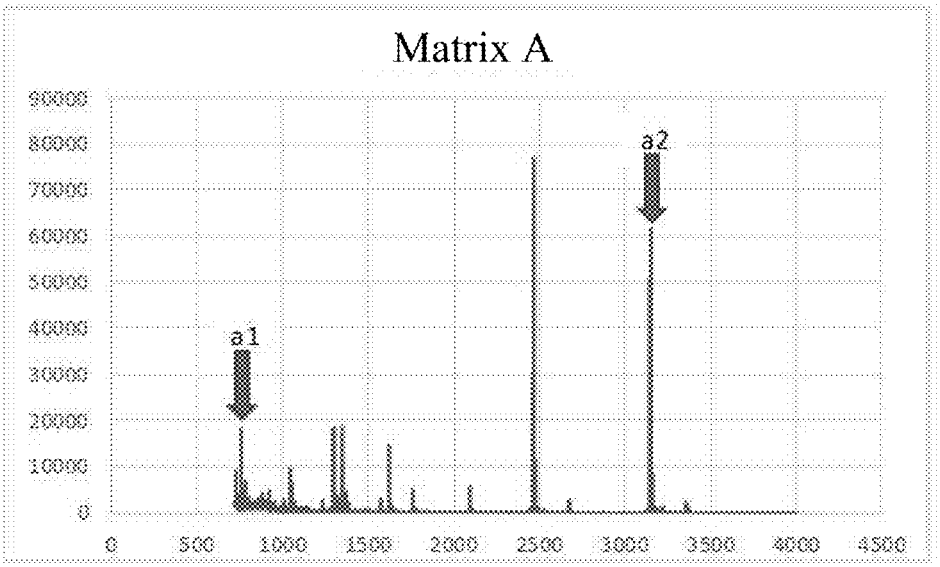
FIG. 7A is a graph depicting one example of a result of MALDI mass spectrometry in Examples.
Figure 7B:
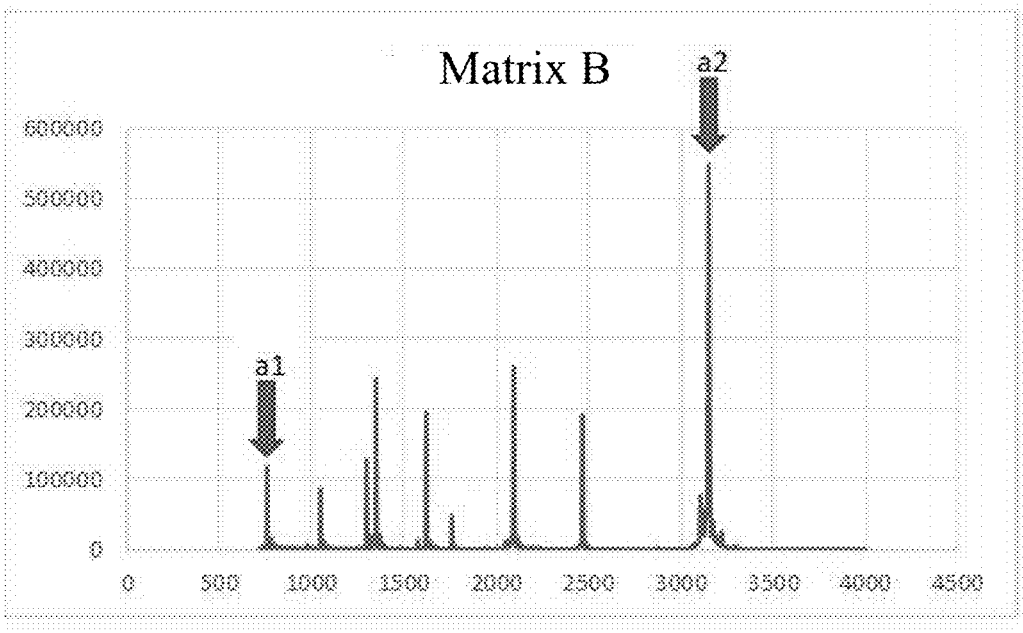
FIG. 7B is a graph depicting one example of a result of MALDI mass spectrometry in Examples.
Figure 7C:
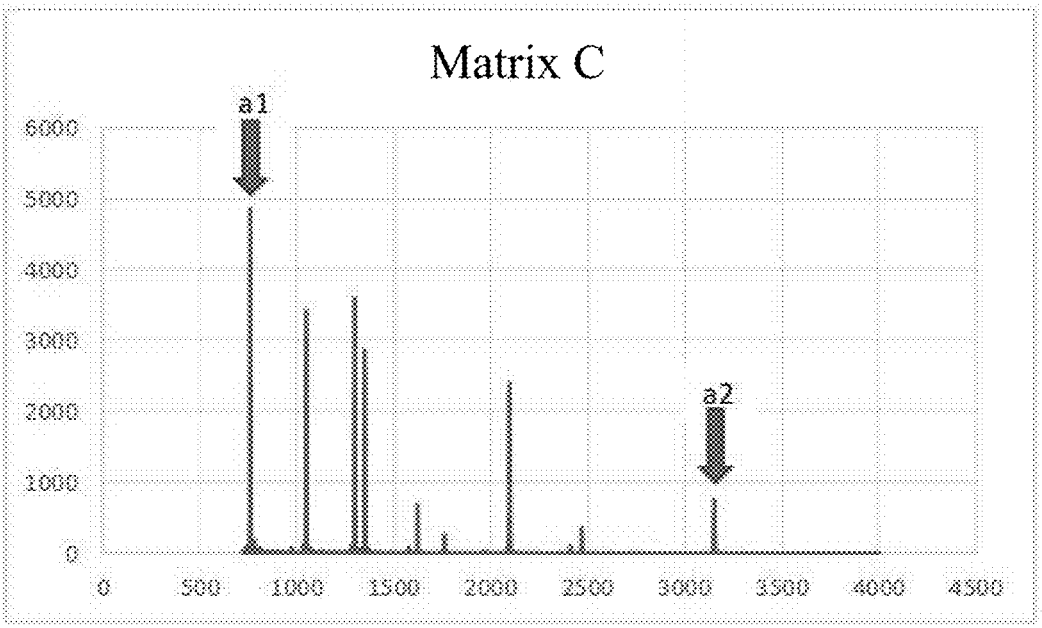
FIG. 7C is a graph depicting one example of a result of MALDI mass spectrometry in Examples.
Figure 8A:
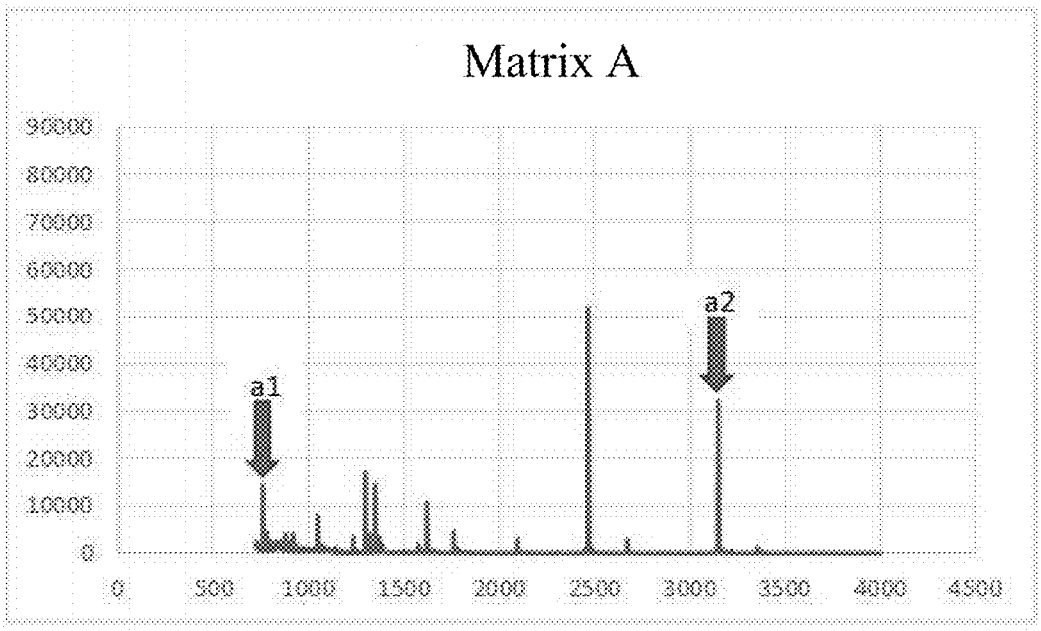
FIG. 8A is a graph depicting one example of a result of MALDI mass spectrometry in Comparative Examples.
Figure 8B:
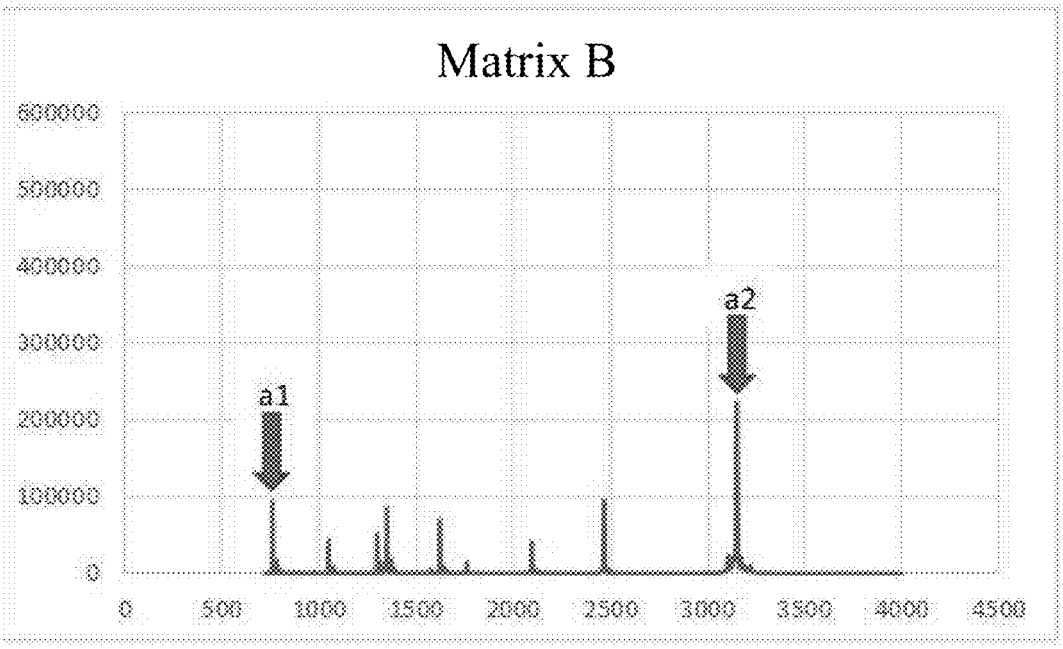
FIG. 8B is a graph depicting one example of a result of MALDI mass spectrometry in Comparative Examples.
Figure 8C:
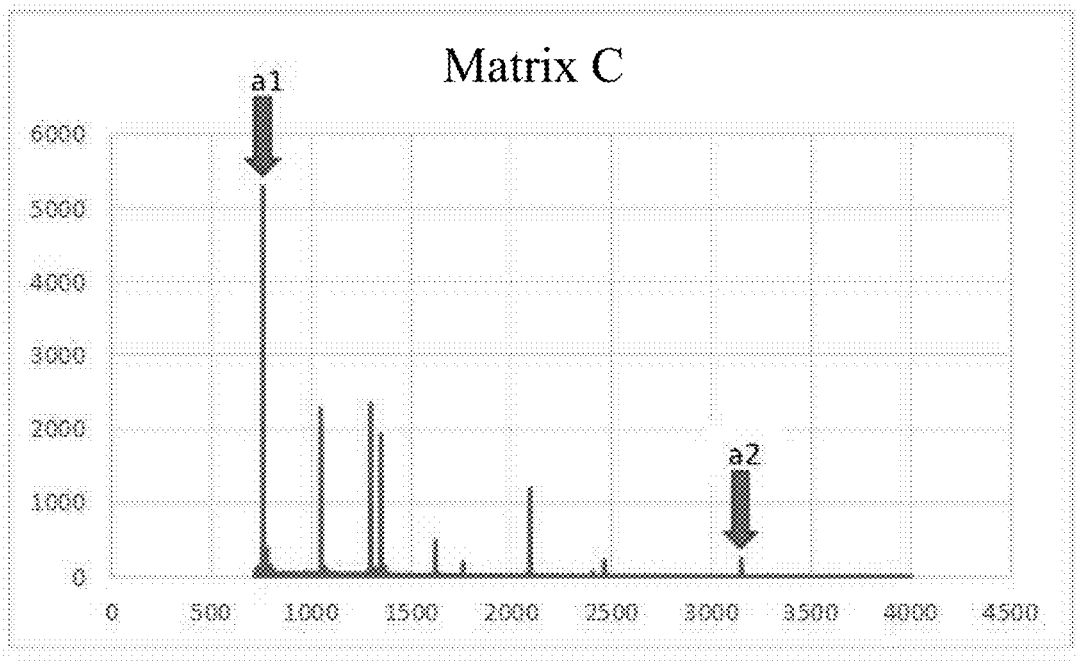
FIG. 8C is a graph depicting one example of a result of MALDI mass spectrometry in Comparative Examples.

Next, as illustrated in FIG. 6B and FIG. 6C, the powder of Matrix A was allowed to fly from Matrix Plate A using Laser beam irradiation unit A for the back surface of Matrix Plate A, to thereby arrange it in sample position A-1 in the form of a square of 10 dots×10 dots with the matrix dot diameter being 200 μm and the dot-to-dot distance being 10 μm. In the same manner as described above, dots of Matrix A were formed in A-2 to A-12 to obtain measurement sample group A for MALDI mass spectrometry.

Example 2

In the same manner as in the preparation of measurement sample group A for MALDI mass spectrometry except that Matrix Plate A was changed to Matrix Plate B to form matrix dots in B-1 to B-12, measurement sample group B for MALDI mass spectrometry was obtained.

Example 3

In the same manner as in the preparation of measurement sample group A for MALDI mass spectrometry except that Matrix Plate A was changed to Matrix Plate C to form matrix dots in C-1 to C-12, measurement sample group C for MALDI mass spectrometry was obtained.

Example 4

As illustrated in FIG. 6A, the powder layer of Matrix A formed on the surface of Matrix Plate A was allowed to face the sample surface of the standard sample group 1 so that an optical vortex laser beam could be vertically applied from Laser beam irradiation unit B to the back surface (the surface with no matrix) of Matrix Plate A. The gap between the standard sample section and the powder layer of Matrix A was set to 100 μm.

Next, as illustrated in FIG. 6B and FIG. 6C, the powder of Matrix A was allowed to fly from Matrix Plate A using Laser beam irradiation unit B for the back surface (the surface with no matrix) of Matrix Plate A, to thereby arrange it in sample position D-1 in the form of a square of 10 dots×10 dots with the matrix dot diameter being 200 μm and the dot-to-dot distance being 10 μm. In the same manner as described above, dots of Matrix A were formed in D-2 to D-12 to obtain measurement sample group D for MALDI mass spectrometry.

Example 5

In the same manner as in the preparation of measurement sample group D for MALDI mass spectrometry except that Matrix Plate A was changed to Matrix Plate B to form matrix dots in E-1 to E-12, measurement sample group E for MALDI mass spectrometry was obtained.

Example 6

In the same manner as in the preparation of measurement sample group D for MALDI mass spectrometry except that Matrix Plate A was changed to Matrix Plate C to form matrix dots in F-1 to F-12, measurement sample group F for MALDI mass spectrometry was obtained.

Example 7

In the same manner as in the preparation of measurement sample group D for MALDI mass spectrometry except that Matrix Plate A was changed to Matrix Plate G to form matrix dots in G-1 to G-12, measurement sample group G for MALDI mass spectrometry was obtained.

Example 8

In the same manner as in the preparation of measurement sample group D for MALDI mass spectrometry except that Matrix Plate A was changed to Matrix Plate H to form matrix dots in H-1 to H-12, measurement sample group H for MALDI mass spectrometry was obtained.

Example 9

As illustrated in FIG. 6A, the powder layer of Matrix A formed on the surface of Matrix Plate A was allowed to face the standard sample on the standard sample group 2 so that a uniformly heating irradiation laser beam could be vertically applied from Laser beam irradiation unit D to the back surface (the surface with no matrix) of Matrix Plate A. The gap between the standard sample section and the powder layer of Matrix A was set to 100 μm.

Next, as illustrated in FIG. 6B and FIG. 6C, the powder of Matrix A was allowed to fly from Matrix Plate A using Laser beam irradiation unit D for the back surface (the surface with no matrix) of Matrix Plate A, to thereby arrange it in sample position A-1 in the form of a square of 10 dots×10 dots with the matrix dot diameter being 200 μm and the dot-to-dot distance being 10 μm. In the same manner as described above, dots of Matrix A were formed in A-2 to A-12 to obtain measurement sample group Q for MALDI mass spectrometry.

Example 10

In the same manner as in the preparation of measurement sample group Q for MALDI mass spectrometry except that Matrix Plate A was changed to Matrix Plate B to form matrix dots in B-1 to B-12, measurement sample group R for MALDI mass spectrometry was obtained.

Comparative Example 1

As illustrated in FIG. 6A, the powder layer of Matrix A formed on the surface of Matrix Plate D was allowed to face the sample surface of the standard sample group 1 so that an optical vortex laser beam could be vertically applied from Laser beam irradiation unit B to the back surface (the surface with no matrix) of Matrix Plate D. The gap between the standard sample section and the powder layer of Matrix A was set to 100 μm.

Next, as illustrated in FIG. 6B and FIG. 6C, the powder of Matrix A was attempted to fly from Matrix Plate A using Laser beam irradiation unit A for the back surface (the surface with no matrix) of Matrix Plate D to form dots in sample position K-1 each having a matrix dot diameter of 200 μm. As a result, Matrix A was not allowed to fly from Matrix Plate D, and matrix dots could not be formed in sample position K-1. However, this was used as measurement sample group K for MALDI mass spectrometry.

Comparative Example 2

In the same manner as described above except that Matrix Plate D was changed to Matrix Plate E and dots each having a matrix dot diameter of 200 μm were attempted to be formed in sample position L-1. As a result, Matrix B was not allowed to fly from Matrix Plate E, and matrix dots could not be formed in sample position L-1. However, this was used as measurement sample group L for MALDI mass spectrometry.

Comparative Example 3

In the same manner as described above except that Matrix Plate D was changed to Matrix Plate F and dots each having a matrix dot diameter of 200 μm were attempted to be formed in sample position M-1. As a result, Matrix C was not allowed to fly from Matrix Plate F, and matrix dots could not be formed in sample position M-1. However, this was used as measurement sample group M for MALDI mass spectrometry.

Comparative Example 4

As illustrated in FIG. 6A, the powder layer of Matrix A formed on the surface of Matrix Plate D was allowed to face the sample surface of standard sample group 1 so that an optical vortex laser beam could be vertically applied by Laser beam irradiation unit C to the back surface (the surface with no matrix) of Matrix Plate D. The gap between the standard sample section and the powder layer of Matrix A was set to 100 μm.

Next, as illustrated in FIG. 6B and FIG. 6C, the powder of Matrix A was allowed to fly from Matrix Plate A using Laser beam irradiation unit A for the back surface (the surface with no matrix) of Matrix Plate A, to thereby arrange it in sample position N-1 in the form of a square of 10 dots×10 dots with the matrix dot diameter being 200 μm and the dot-to-dot distance being 10 μm. In the same manner as described above, dots of Matrix A were formed in N-2 to N-12 to obtain measurement sample group N for MALDI mass spectrometry.

Comparative Example 5

In the same manner as in the preparation of measurement sample group N for MALDI mass spectrometry except that Matrix Plate D was changed to Matrix Plate E to form matrix dots in O-1 to O-12, measurement sample group 0 for MALDI mass spectrometry was obtained.

Comparative Example 6

In the same manner as in the preparation of measurement sample group N for MALDI mass spectrometry except that Matrix Plate D was changed to Matrix Plate F to form matrix dots in P-1 to P-12, measurement sample group P for MALDI mass spectrometry was obtained.

Next, "presence or absence of flying of the matrix" and "detection sensitivity of MALDI mass spectrometry" were evaluated in the following manners.

[Comparison of Flying of Matrix by Different Lasers]

Flying of a matrix was compared between use of Laser beam irradiation unit A and use of Laser beam irradiation unit B in the present disclosure.

Figure 9D:
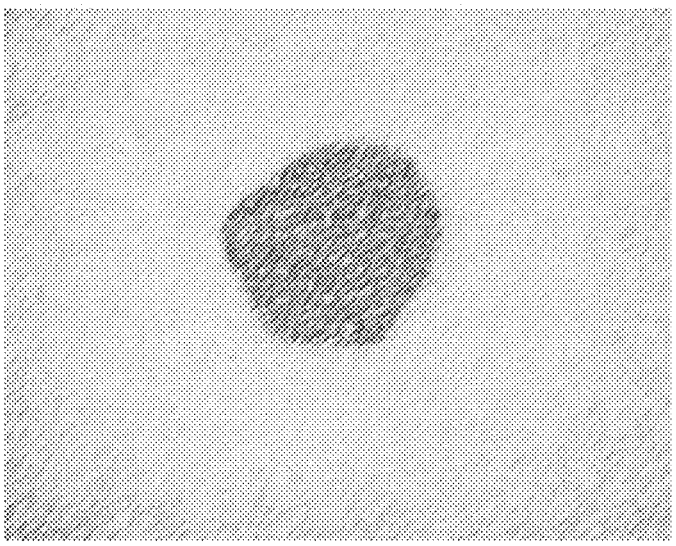
FIG. 9D is a photograph depicting one example of a preparation method of a measurement sample for MALDI mass spectrometry using an optical vortex laser beam.

In order to make a matrix fly, a dye plate was used which used red organic dye acid red 151 as a matrix layer instead of an invisible matrix because of its colorless transparency. The red organic dye acid red 151 is an organic low-molecular-weight substance that is visible and has crystallinity similar to the matrix of the present disclosure. Results of comparison of flying are presented in FIG. 9B and FIG. 9D.

When disposing the matrix to a predetermined position by the Gaussian laser 91 of Laser beam irradiation unit A, scattered dots are easily formed with the gap that is large between the standard sample section and the matrix layer (FIG. 9B), which needs to make the gap small. However, scattered dots are not easily formed by use of the optical vortex laser beam 92 of Laser beam irradiation unit B (FIG. 9D), which makes it possible to broaden the gap between the standard sample section and the matrix layer. As a result, it is possible for the sample section to receive a less extent of damage (e.g., a change in molecular weight) when making the matrix fly to the sample section.

In the experiments in the present disclosure, Laser beam irradiation unit B formed accurate dots without formation of scattered dots with the gap of 200 μm between the standard sample section and the matrix layer. Meanwhile, Laser beam irradiation unit B formed scattered dots without adjusting the gap to 100 μm, and could not form accurate dots equivalent to those formed by Laser beam irradiation unit B.

[MALDI Mass Spectrometry]

The measurement sample groups A to P for MALDI mass spectrometry, on which the powder or the matrix was disposed, were subjected to MALDI mass spectrometry using MALDI-TOF-MS (AUTOFLEX III LRF200-CID, obtained from Bruker Daltonics Co., Ltd.). Representative examples of the results are presented in FIG. 7A to FIG. 7C and FIG. 8A to FIG. 8C. In FIG. 7A to FIG. 7C and FIG. 8A to FIG. 8C, the horizontal axis denotes mass (m/z) and the vertical axis denotes detection intensity.

[Evaluation Method]

The measured data were evaluated as follows.

—Impact on the Sample—

For detection data of 12 points of each of the measurement sample groups for MALDI mass spectrometry, scanning was performed per one point at a laser energy intensity of 50% to measure a detection peak of the detection target at the time of 1500 shots. A value of the detection peak is greatly different depending on the kind of a matrix. However, a component having a relatively high molecular weight is prone to the impact of the laser upon flying of the matrix. Larger damage cuts more molecular chains, and the detection peak ratio tends to decrease.

Damage of the standard sample was evaluated based on the ratio (Y/X), where X denotes the detection peak intensity of somatostatin 28 (the peak indicated by the arrow a1 in the figure) near a relatively small molecular weight of 759 and Y denotes the detection peak intensity of bradykinin (1-7) (the peak indicated by the arrow a2 in the figure) near a relatively large molecular weight of 3149 among the representative peaks of the standard sample.

[Evaluation Criteria]

In the cases of using Matrices A and B, the lowest value of the above detection intensity ratio (Y/X) in the detection data of 12 points was evaluated based on the following evaluation criteria.

Good: Lowest value of the detection intensity ratio (Y/X) was 3 or greater.

Detectable: Lowest value of the detection intensity ratio (Y/X) was 1 or greater but less than 3.

Undetectable: Lowest value of the detection intensity ratio (Y/X) was less than 1.

In the case of using Matrix C, the lowest value of the above detection intensity ratio (Y/X) in the detection data of 12 points was evaluated based on the following evaluation criteria. Matrix C is such a kind of matrix that does not easily give the detection intensity of a component having a relatively high molecular weight.

Good: Lowest value of the detection intensity ratio (Y/X) was 0.1 or greater.

Detectable: Lowest value of the detection intensity ratio (Y/X) was 0.05 or greater but less than 0.1.

Undetectable: Lowest value of the detection intensity ratio (Y/X) was less than 0.05.

—Variation in Detection (Fluctuation)—

For detection data of 12 points of each of the measurement sample groups for MALDI mass spectrometry, the average value Ave, the maximum value Max, and the minimum value Min of the detection intensity ratio (Y/X) were evaluated based on the following evaluation criteria. Results are presented in Table 1-1 and Table 1-2. The variation in the detection (fluctuation) was evaluated using the value calculated from the formula $\{(Max-Min)/(2\times Ave)\}\times 100$ described in the following evaluation criteria.

[Evaluation Criteria]

In the case of using Matrices A and B

Very good: Value calculated from $\{(Max-Min)/(2\times Ave)\}\times 100$ was less than 10%.

Good: Value calculated from $\{(Max-Min)/(2\times Ave)\}\times 100$ was 10% or greater but less than 15%.

Fair: Value calculated from $\{(Max-Min)/(2\times Ave)\}\times 100$ was 15% or greater but less than 20%.

Poor: Value calculated from $\{(Max-Min)/(2\times Ave)\}\times 100$ was 20% or greater.

In the case of using Matric C

Very good: Value calculated from $\{(Max-Min)/(2\times Ave)\}\times 100$ was less than 10%.

Good: Value calculated from $\{(Max-Min)/(2\times Ave)\}\times 100$ was 10% or greater but less than 20%.

Fair: Value calculated from $\{(Max-Min)/(2\times Ave)\}\times 100$ was 20% or greater but less than 40%.

Poor: Value calculated from $\{(Max-Min)/(2\times Ave)\}\times 100$ was 40% or greater.

TABLE 1-1

| | | | Matrix Plates | | | | | | | Evaluation Results | | |
|---|---|---|---|---|---|---|---|---|---|---|---|---|
| | | | | | | | | | | | MALDI mass spectrometry | |
| | | | | Laser energy | | Matrix layer | Laser Irradiation unit | | | Presence | | Variation in |
| | | Measurement sample | Kind | absorbable layer | Kind of matrix | forming method | Kind | Wavelength of laser | Kind of laser | or absence of flying | Detection sensitivity | detection (Fluctuation) |
| Examples | 1 | Sample A | A | Gold | A | Powder formation | A | 532 nm | Gaussian | Presence | Good | Fair |
| | 2 | Sample B | B | Gold | B | Powder formation | A | 532 nm | Gaussian | Presence | Good | Fair |
| | 3 | Sample C | C | Gold | C | Powder formation | A | 532 nm | Gaussian | Presence | Good | Fair |
| | 4 | Sample D | A | Gold | A | Powder formation | B | 532 nm | Optical vortex | Presence | Good | Good |
| | 5 | Sample E | B | Gold | B | Powder formation | B | 532 nm | Optical vortex | Presence | Good | Good |
| | 6 | Sample F | C | Gold | C | Powder formation | B | 532 nm | Optical vortex | Presence | Good | Good |
| | 7 | Sample G | G | Gold | A | Electrostatic coating | B | 532 nm | Optical vortex | Presence | Good | Very good |
| | 8 | Sample H | H | Gold | B | Electrostatic coating | B | 532 nm | Optical vortex | Presence | Good | Very good |

TABLE 1-1-continued

| | | Matrix Plates | | | | | | | | Evaluation Results | | |
|---|---|---|---|---|---|---|---|---|---|---|---|---|
| | | | | | | | | | | | MALDI mass spectrometry | |
| | | | | Laser energy | | Matrix layer | Laser Irradiation unit | | | Presence | | Variation in |
| | | Measurement sample | Kind | absorbable layer | Kind of matrix | forming method | Kind | Wavelength of laser | Kind of laser | or absence of flying | Detection sensitivity | detection (Fluctuation) |
| | 9 | Sample Q | A | Gold | A | Powder formation | D | 532 nm | Uniformly heating | Presence | Good | Very good |
| | 10 | Sample R | B | Gold | B | Powder formation | D | 532 nm | Uniformly heating | Presence | Good | Very good |

TABLE 1-2

| | | Matrix Plates | | | | | | | | Evaluation Results | | |
|---|---|---|---|---|---|---|---|---|---|---|---|---|
| | | | | | | | | | | | MALDI mass spectrometry | |
| | | | | Laser energy | | Matrix layer | Laser Irradiation unit | | | Presence | | Variation in |
| | | Measurement sample | Kind | absorbable layer | Kind of matrix | forming method | Kind | Wavelength of laser | Kind of laser | or absence of flying | Detection sensitivity | detection (Fluctuation) |
| Comparative Examples | 1 | Sample K | D | None | A | Powder formation | B | 532 nm | Optical vortex | Absence | Undetectable | — |
| | 2 | Sample L | E | None | B | Powder formation | B | 532 nm | Optical vortex | Absence | Undetectable | — |
| | 3 | Sample M | F | None | C | Powder formation | B | 532 nm | Optical vortex | Absence | Undetectable | — |
| | 4 | Sample N | D | None | A | Powder formation | C | 345 nm | Optical vortex | Presence | Detectable | Poor |
| | 5 | Sample O | E | None | B | Powder formation | C | 345 nm | Optical vortex | Presence | Detectable | Poor |
| | 6 | Sample P | F | None | C | Powder formation | C | 345 nm | Optical vortex | Presence | Undetectable | Poor |

Embodiments of the present disclosure are as follows, for example.

<1> A method for preparing a measurement sample for MALDI mass spectrometry, the method including applying a laser beam to a base including a matrix used for preparing the measurement sample for MALDI mass spectrometry, the matrix being disposed on a surface of the base, in a manner that the laser beam is applied to a surface of the base opposite to the surface including the matrix, to make the matrix fly from the base to be disposed at a predetermined position of an analyte of MALDI mass spectrometry, wherein the base includes a laser energy absorbable material, and wherein laser energy of the laser beam has a wavelength of 400 nm or longer.

<2> The method according to <1>, wherein the laser energy absorbable material is on the base, and the matrix is on the laser energy absorbable material.

<3> The method according to <1> or <2>, wherein the laser energy absorbable material has a transmittance to the laser beam of 60% or less.

<4> The method according to any one of <1> to <3>, wherein the laser energy absorbable material is a metal thin film.

<5> The method according to <4>, wherein the metal is gold.

<6> The method according to any one of <1> to <5>, wherein the matrix made fly from the base is two or more kinds of matrices.

<7> The method according to any one of <1> to <5>, wherein the two or more kinds of matrices made fly from the base are disposed at mutually different predetermined positions of the analyte of MALDI mass spectrometry.

<8> The method according to any one of <1> to <7>, wherein the matrix is made fly twice or more from the base to be disposed at the predetermined position of the analyte of MALDI mass spectrometry.

<9> The method according to any one of <1> to <8>, wherein the laser beam is an optical vortex laser beam.

<10> The method according to any one of <1> to <8>, wherein the laser beam is a uniformly heating irradiation laser beam.

<11> A device for preparing a measurement sample for MALDI mass spectrometry, the device being used for the method according to any one of <1> to <10> and including an irradiation unit configured to apply the laser beam to the surface of the base.

<12> A base for preparing a measurement sample for MALDI mass spectrometry, the base including:

a substrate;

a laser energy absorbable material that can absorb energy of a laser beam having a wavelength of 400 nm or longer; and a matrix, the laser energy absorbable material being on the substrate, the matrix being on the laser energy absorbable material.

<13> The base according to <12>, wherein the laser energy absorbable material is a metal thin film.

<14> The base according to <13>, wherein the metal is gold.

The method according to any one of <1> to <10> above, the device according to <11> above, and the base according to any one of <12> to <14> above can solve the above-described problems in the art and achieve the object of the present disclosure.

What is claimed is:

1. A method for preparing a measurement sample for MALDI mass spectrometry, the method comprising applying a laser beam to a base comprising a matrix used for preparing the measurement sample for MALDI mass spectrometry, the matrix being disposed on a surface of the base, in a manner that the laser beam is applied to a surface of the base opposite to the surface comprising the matrix, to make the matrix fly from the base to be disposed at a predetermined position of an analyte of MALDI mass spectrometry, wherein the base comprises a laser energy absorbable material, and wherein laser energy of the laser beam has a wavelength of 400 nm or longer.

2. The method according to claim 1, wherein the laser energy absorbable material is on the base, and the matrix is on the laser energy absorbable material.

3. The method according to claim 1, wherein the laser energy absorbable material has a transmittance to the laser beam of 60% or less.

4. The method according to claim 1, wherein the laser energy absorbable material is a metal thin film.

5. The method according to claim 4, wherein the metal is gold.

6. The method according to claim 1, wherein the matrix made fly from the base is two or more kinds of matrices.

7. The method according to claim 1, wherein the two or more kinds of matrices made fly from the base are disposed at mutually different predetermined positions of the analyte of MALDI mass spectrometry.

8. The method according to claim 1, wherein the matrix is made fly twice or more from the base to be disposed at the predetermined position of the analyte of MALDI mass spectrometry.

9. The method according to claim 1, wherein the laser beam is an optical vortex laser beam.

10. The method according to claim 1, wherein the laser beam is a uniformly heating irradiation laser beam.

11. A device for preparing a measurement sample for MALDI mass spectrometry, the device being used for the method according to claim 1 and comprising an irradiator to apply the laser beam to the surface of the base.

12. A base for preparing a measurement sample for MALDI mass spectrometry, the base comprising:

a substrate;

a laser energy absorbable material that can absorb energy of a laser beam having a wavelength of 400 nm or longer; and a matrix, the laser energy absorbable material being on the substrate, the matrix being on the laser energy absorbable material.

13. The base according to claim 12, wherein the laser energy absorbable material is a metal thin film.

14. The base according to claim 13, wherein the metal is gold.

* * * * *